US011753054B2

(12) United States Patent
Green et al.

(10) Patent No.: US 11,753,054 B2
(45) Date of Patent: Sep. 12, 2023

(54) RAIL VEHICLE OBSTACLE AVOIDANCE AND VEHICLE LOCALIZATION

(71) Applicant: THALES CANADA INC, Toronto (CA)

(72) Inventors: Alon Green, Toronto (CA); Kevin Tobin, Toronto (CA); Marco De Thomasis, Toronto (CA)

(73) Assignee: THALES CANADA INC, Ontario (CA)

( * ) Notice: Subject to any disclaimer, the term of this patent is extended or adjusted under 35 U.S.C. 154(b) by 494 days.

(21) Appl. No.: 16/714,175

(22) Filed: Dec. 13, 2019

(65) Prior Publication Data

US 2020/0189633 A1 Jun. 18, 2020

Related U.S. Application Data

(60) Provisional application No. 62/779,969, filed on Dec. 14, 2018.

(51) Int. Cl.
*B61L 25/02* (2006.01)

(52) U.S. Cl.
CPC ..... *B61L 25/025* (2013.01)

(58) Field of Classification Search
CPC ..... B61L 23/041; B61L 23/34; B61L 25/025
See application file for complete search history.

(56) References Cited

U.S. PATENT DOCUMENTS

| | | | | |
|---|---|---|---|---|
| 3,365,572 | A | 1/1968 | Strauss | |
| 4,723,737 | A | 2/1988 | Mimoun | |
| 4,965,583 | A | 10/1990 | Broxmeyer | |
| 5,574,469 | A | 11/1996 | Hsu | |
| 5,757,291 | A | 5/1998 | Kull | |
| 8,185,264 | B2 | 5/2012 | Carroll | |
| 9,037,339 | B2 | 5/2015 | Kanner et al. | |
| 9,994,242 | B2 | 6/2018 | Bartek | |
| 10,370,015 | B2 | 8/2019 | Chu et al. | |
| 2012/0296562 | A1* | 11/2012 | Carlson | B61L 25/025 701/301 |
| 2015/0175178 | A1* | 6/2015 | Ignatius | B61L 23/041 246/120 |
| 2018/0105190 | A1 | 4/2018 | Becke et al. | |
| 2018/0222505 | A1* | 8/2018 | Chung | B61L 3/008 |
| 2018/0327010 | A1 | 11/2018 | Kernwein et al. | |

(Continued)

FOREIGN PATENT DOCUMENTS

| | | |
|---|---|---|
| CN | 1628048 | 6/2005 |
| CN | 105730475 | 7/2016 |
| EP | 3339133 A1 | 6/2018 |
| JP | 2017506050 A | 2/2017 |

(Continued)

OTHER PUBLICATIONS

Alcock et al., "Poster Abstract: Combining Positioning & Communication Using Ultra Wideband Transceivers", Infolab21, Lancaster University, UK.

(Continued)

*Primary Examiner* — Tyler J Lee
*Assistant Examiner* — Yufeng Zhang
(74) *Attorney, Agent, or Firm* — Hauptman Ham, LLP

(57) ABSTRACT

A method for determining rail vehicle location and identifying obstacles, which includes operations of transmitting, from at least two vehicle beacons on a first vehicle, a ranging signal to at least two external beacons; receiving, at the at least two vehicle beacons, a return signal from the at least two external beacons; and determining, based on the return signal from the at least two external beacons, a position of each of the external beacons with respect to the at least two vehicle beacons of the first vehicle.

20 Claims, 29 Drawing Sheets

(56) References Cited

U.S. PATENT DOCUMENTS

| | | | | |
|---|---|---|---|---|
| 2019/0248392 | A1 | 8/2019 | Bar-Tal et al. | |
| 2020/0086901 | A1* | 3/2020 | Kojima | B61L 23/34 |
| 2020/0189633 | A1 | 6/2020 | Green et al. | |

FOREIGN PATENT DOCUMENTS

| | | | |
|---|---|---|---|
| WO | 2005048000 | A2 | 5/2005 |
| WO | 2018123679 | A1 | 7/2018 |
| WO | 2018158712 | A1 | 9/2018 |
| WO | 2020121281 | A1 | 6/2020 |

OTHER PUBLICATIONS

Aparna et al., "Emergency Management of Urban Rail Transportation Using CBTC System", SSRG International Journal of Electronics and Communication Engineering, vol. 2, Issue 3, Mar. 2015, pp. 1-8.

Gu et al., "A Wireless Subway Collision Avoidance System Based on Zigbee Networks", Journal of Communications, vol. 8, No. 9, Sep. 2013, pp. 561-565.

Partial Supplementary European Search Report issued in corresponding European Application No. 19895326.7, dated Aug. 4, 2022, pp. 1-16, European Patent Office, Munich, Germany.

Canadian Examination Search Report issued in corresponding Canadian Application No. 3,120,502, dated Jun. 13, 2022, pp. 1-4.

Korean Office Action issued in corresponding Korean Application No. 10-2021-7020292, dated Jan. 27, 2023, pp. 1-14, Korean Intellectual Property Office, Daejeon, Republic of Korea.

Extended European Search Report issued in corresponding European Application No. 19895326.7, dated Dec. 7, 2022, pp. 1-15, European Patent Office, Munich, Germany.

* cited by examiner 100
102A
106A
102
106B
102B
108

120
102L1
102L1H
110A
ω
112
102A
102R1
102R1H
106A
108

140
102L2
110B
ω
112
102B
102R2
102R2H
102L2H
106B
108

RAIL VEHICLE OBSTACLE AVOIDANCE AND VEHICLE LOCALIZATION

PRIORITY CLAIM

This application claims the priority of U.S. Provisional Application No. 62/779,969, filed Dec. 14, 2018, which is incorporated herein by reference in its entirety.

BACKGROUND

Sensors and safety systems are mounted on trains and rail vehicles in order to improve safety of train operators and persons working on or near train tracks during rail operations. Integrating sensors and safety systems increase the safety of rail operation while lowering the operational cost of vehicle movement on tracks, and expanding the flexibility of routing vehicles along tracks.

DETAILED DESCRIPTION

Figures 1A, 1B, 1C:
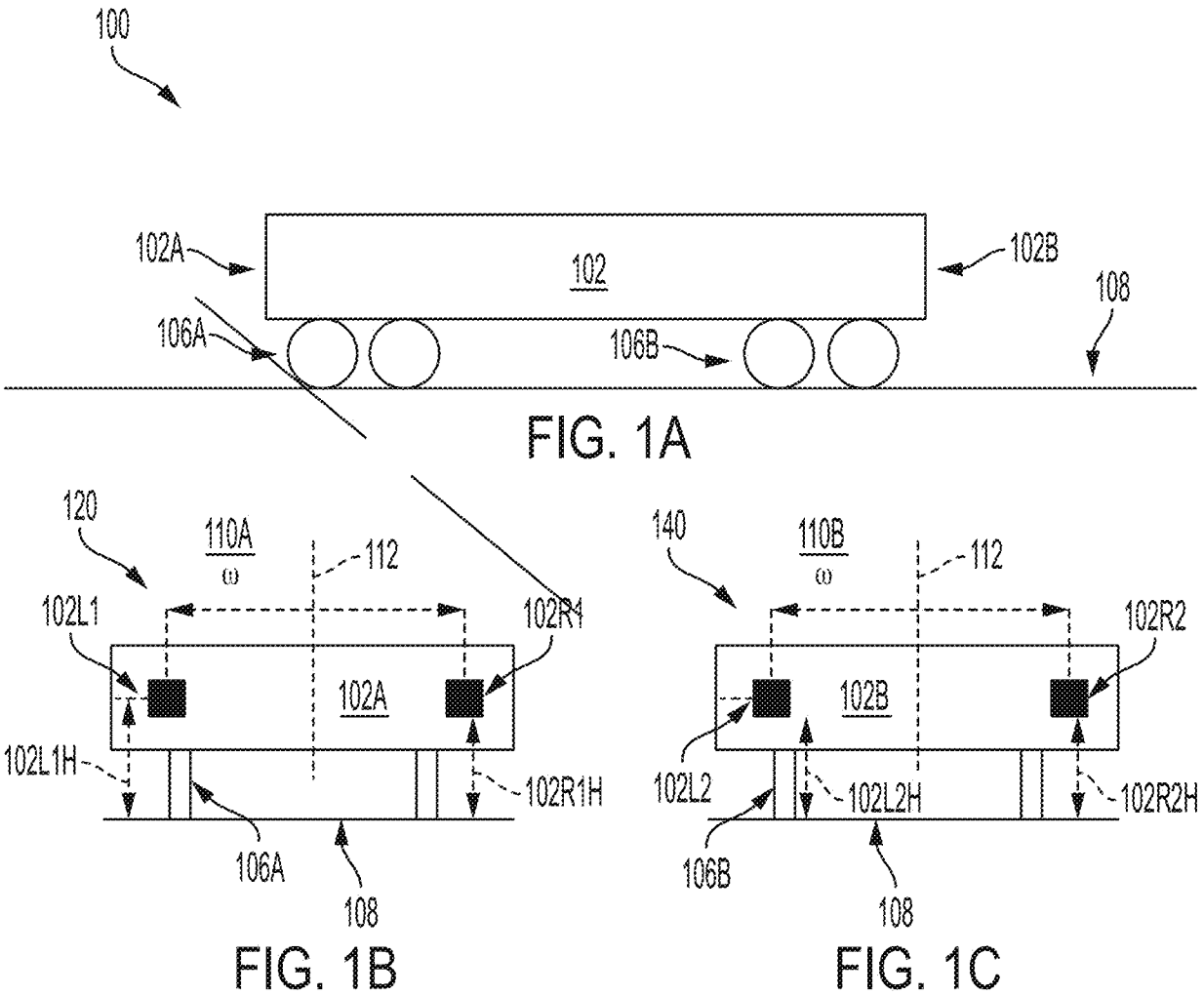
FIGS. 1A-1C are views of a vehicle with beacons, in accordance with some embodiments.

The following disclosure provides many different embodiments, or examples, for implementing different features of the provided subject matter. Specific examples of components, values, operations, materials, arrangements, etc., are described below to simplify the present disclosure. These are, of course, merely examples and are not intended to be limiting. Other components, values, operations, materials, arrangements, etc., are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Safe operation of vehicles on railways and guideways includes safety features such as obstacle avoidance and location tracking in order to avoid collisions between vehicles on a railway or guideway. Obstacle avoidance is accomplished in some instances by interlocking, the process of routing vehicles along an authorized route along a set of rails or guideways, where the authorized route is locked and reserved for a single vehicle at a time. Interlocking is sometimes performed for large sections or a set of rails or a long section of a guideway, at the cost of reduced routing flexibility for vehicles traveling along the railways. Shortening the length of a railway which is used for interlocking provides greater flexibility of switching or routing vehicles along the railway, but involves greater complexity in managing the vehicles traveling along the railway. In some instances, using interlocking leads to sections of rails being under-utilized for traffic because of limitations on dividing the railway into interlockable sections, leaving some vehicles immobile until an interlockable section of railway is available for rail traffic.

Dynamic traffic management along a railway involves having trains and vehicles traveling on sections of the railway communicate information to a central or distributed traffic controller to provide movement authority to each vehicle. Vehicles follow the movement authority from the traffic controller and remain stationary without movement authority. Dynamic traffic management avoids collisions between vehicles by maintaining communication between each vehicle and the traffic controller so that vehicles and the traffic controller know vehicle positions and/or vehicle velocities. Based on the known and communicated vehicle position information, movement authority is transmitted from the traffic controller to each vehicle to avoid collisions with obstacles (e.g., other vehicles) along the railway. Loss of communication between a vehicle and the traffic controller introduces risk of collision between vehicles the traffic controller's knowledge of vehicle positions becomes incomplete. Dynamic traffic management is used for both attend vehicle operation (attended train operation, ATO) and unattended vehicle operation (unattended train operation, UTO).

Attended train operation is a mode of operation in which trains or vehicles have a human operator regulating motion of the train or vehicle along the railway. Unattended train operation is a mode of operation in which a train or vehicle is operated remotely, with no human operation on board. In some instances, unattended train operation is used to position trains or vehicles along a railway to increase delivery efficiency of the rail system. In some embodiments of attended train operation, loss of communication between the vehicle and a traffic controller is remedied by having a human operator reset the communication system. In some embodiments of unattended train operation, loss of communication between the vehicle and the traffic controller results in the unattended vehicle stop moving when the communication loss is detected, and wait until a human operator is able to travel to the vehicle to reset communication systems, or to repair the communication systems. Waiting for a human operator to travel to the stopped unattended vehicle causes time delays and increases operational costs of the rail system. Localization occurs upon restoring communication between a vehicle and the traffic controller for the vehicle. Localization is the process of reestablishing vehicle position. In some embodiments, localization occurs by the stopped vehicle communicating directly with a traffic controller. In some embodiments of the present disclosure, localization occurs by the stopped vehicle communicating with another vehicle on the railway, and calculating the stopped vehicle position based on the known position of the other vehicle (included in a coded pulse transmitted between the vehicles) and the time of flight of transmitted signals received from the other vehicle.

For purposes of the present disclosure, a vehicle is a road or rail vehicle which cannot be uncoupled to a shorter or smaller operational unit. A rail vehicle is a vehicle configured to operate only on the railway. A road vehicle is a vehicle which is able to operate on the railway, or alternatively, on a road. A train is a rail operational unit which includes a single vehicle or multiple vehicles coupled together. A vehicle of interest is a vehicle which is responsible for avoiding a collision with another vehicle. In some embodiments, the vehicle of interest is a moving vehicle, and other vehicles are either moving or stationary, on a same track or a different track of the railway. A failed vehicle is a vehicle on the railway (or guideway or track) with an unknown position, or out of communication with the traffic controller. Localization is the process of establishing or initializing a vehicle position on the railway. An obstacle is a vehicle with which a vehicle of interest will collide without intervention to prevent the collision. A beacon is a component of an obstacle avoidance system, or a vehicle localization system, which receives signals from other beacons and transmits reply signals (e.g., response pulses) to the other beacons. Signals transmitted between beacons include coded information related to the beacon location and/or a vehicle to which the beacon is affixed. Line-of-sight (LOS) refers to beacons which have no intervening obstructions during transmission of coded signals between the beacons. Time of flight refers to the amount of time between the transmission of a coded signal from a first beacon and the receipt of the coded signal by a second beacon. Field of view refers to the area "visible" to a beacon during transmission of coded signals between beacons.

Several methods of obstacle avoidance are described below, in approximately increasing degrees of efficiency for the rail system. A first type of obstacle avoidance is called interlocking, or routing of vehicles along an authorized route that is locked and reserved for the vehicle, and tracking the vehicle along that route based on track circuits or axle counting blocks occupancies. Interlocking and tracking vehicles along the dedicated route is one of the safest means of obstacle avoidance. However, the increased safety comes at a cost of operational efficiency because dedicating reserve tracks for a vehicle prevents all other traffic from moving along the stretch of track dedicated to the moving vehicle. Efficiency increases by reducing the length of the stretch of dedicated track when possible.

A second type of obstacle avoidance, dynamic traffic control (traffic control, whether centralized or distributed), involves communications between the vehicles moving along a section of track and a central/distributed controller (traffic controller) which provides movement authority to each vehicle along the section of track (e.g., within the traffic controller's territory). Under old forms of dynamic traffic control, a vehicle only moves upon receiving movement authority, based on communication between the traffic controller and the vehicle, and a knowledge of the positions of vehicles along the section of track. Dynamic traffic control is used for both attended train operation (ATO) and unattended train operation (UTO). Loss of signal between a vehicle or train and the traffic controller results in revocation of movement authority for the train, and the human operator (for ATO) or the onboard train controller (for UTO) halts the vehicle or train until communication is restored and localization has occurred.

In the present disclosure, the scope of dynamic traffic control is expanded by allowing operation of vehicles within the traffic controller territory without constant communication between the vehicle and the traffic controller. The expanded operation includes a method of allowing a failed vehicle in a UTO system to continue to operate safely in an unattended mode of operation by detecting the positions of other vehicles, determining whether one of the detected vehicles is an obstacle, and commanding the vehicle of interest to begin emergency braking after identification of an obstacle. The expanded scope of dynamic traffic control further includes a method of allowing a failed UTO vehicle to perform localization after, e.g., a communication failure, using a known position of another vehicle on the railway near the failed UTO vehicle.

The present disclosure describes a train communication system which includes both a hardware component and computer-based instructions to perform, e.g., localization and/or unattended train operation or emergency braking based on information sent from or received by the hardware components described below. FIGS. 1A-1C are views of a vehicle 102 with beacons, in accordance with some embodiments. FIGS. 1A, 1B, and 1C are views of a vehicle 102 having a simplest, fully symmetric arrangement of beacons on the ends of the vehicle 102. FIG. 1A is a side view 100 of vehicle 102, with a first end 102A (an "A"-end) and a second end 102B (a "B"-end). Vehicle 102 has a first set of wheels 106A at the A-end, and a second set of wheels 106B at the B-end of vehicle 102. According to some embodiments, the A-end of a vehicle is the end which is facing the direction of travel along a railway, and the B-end of the vehicle is the end which faces back in the direction from which the vehicle has traveled. The first set of wheels 106A and the second set of wheels 106B are on track 108, a set of rails which retain the wheels of the vehicle 102 and restrain motion of the vehicle to be along the direction in which track 108 extends.

Beacons mounted on a face or end of a vehicle include one or more of a UWB (ultrawide band) radar, a pulse radar, a commercial/off the shelf (COTS) FMCW radar and paired radar target generator, a LiDAR, or any other kind of device or sensor which is configurable to receive coded pulses and transmit coded pulses between beacons. Decreasing the turnaround time between a beacon receiving a transmitted pulse from a transmitting beacon, and sending a reply pulse improves the accuracy of position determination between beacons on a vehicle of interest and other beacons. In some embodiments, picosecond accuracy of signal receipt and transmission is used to calculate positions with accuracy of less than ±1 centimeter. Beacons which send reply pulses, having received a transmitted coded pulse from a vehicle-mounted beacon, are to be configured to accurately account for delays and latency in making coded reply transmissions to determine vehicle positions.

Beacons which send reply pulses send the reply pulse as soon as possible after receiving a transmitted coded pulse from a transmitting beacon. By reducing the latency (delay between receiving the transmitted coded pulse and sending the reply pulse), the accuracy of position measurement is improved. In some embodiments, latency smaller than 1 picosecond (ps) is achieved and provides position accuracy to within ±1 cm. In embodiments where latency is greater than 1 ps, the latency information is added to the coded reply pulse for use by the vehicle of interest in calculating inter-vehicle distance and inter-beacon distances.

According to some embodiments, a beacon includes both a transmitting antenna and a receiving antenna. In some embodiments, the beacon includes a single antenna which is configured to both receive and transmit pulses between beacons associated with rail operations. In some embodiments, the beacons include a data storage component which stores coded information transmitted to other beacons in coded pulses. In some embodiments, beacons are configured to pass coded information through from a control mechanism and data storage component situated elsewhere in the vehicle, but do not retain data in the beacon. Adding data storage and computational abilities to beacons decreases the turnaround time between a beacon receiving a coded pulse from a transmitting beacon on another vehicle, and sending a reply pulse or response pulse back to the transmitting beacon with coded information specific to the particular beacon generating and transmitting the reply or response pulse. Decreasing response time (e.g., decreasing the latency for responding to the transmitted signal) increases the accuracy of distance measurements using, e.g., time of flight calculations for pulses between beacons.

FIG. 1B is an end view 120 of the first end 102A of vehicle 102, in accordance with some embodiments. Elements of FIG. 1A which correspond to elements of FIG. 1B are given a same identifying numeral for convenience. First end 102A has a first beacon 102L1 and a second beacon 102R1 mounted thereon. First beacon 102L1 and second beacon 102R1 are a beacon separation distance (ω), or first separation distance 110A, apart from each other. First beacon 102L1 and second beacon 102R1 are symmetrically positioned on the first end 102A of vehicle 102 with respect to a vehicle centerline 112. First beacon 102L1 is at a beacon height (h), or first beacon elevation 102L1H, above track 108, and second beacon 102R1 is at the same beacon height (h), or a second beacon elevation 102R1H, above track 108. Beacon height above the track is made as large as possible in order to increase the detection range of the beacon as much as possible, increasing the size of the territory over which inter-beacon distance measurements are made with accuracy.

In some embodiments, beacon separation distances (ω) range from about 1 to about 3 meters (m), although other beacon separation distances are also within the scope of the present disclosure. Beacon separation distances greater than about 1 meter provide more accurate inter-vehicle distance measurements than beacon separation distances smaller than about 1 meter. Beacon separation distances greater than about 3 meters are sometimes impractical, based on the standard gauge of tracks or railways in a country, the smallest inter-track separation distances used on a railway, and the widths of vehicles used on a railway. Beacons are fastened to an end of a rail vehicle, either directly, or by means of a mounting bracket on an end of a vehicle. In some embodiments, beacon separation distances are reduced to as little as a few centimeters, depending on the accuracy of the inter-vehicle distance measurement (range measurement) of the beacon system being employed. Shorter-wavelength electromagnetic signals provide greater positional accuracy when performing range measurement, but are more prone to interference by ambient conditions (rain, snow, and so forth).

For purposes of the present disclosure, beacons at an end of a vehicle are treated as being in a common plane at the end of the vehicle, the plane being parallel to a plane extending through the end of the vehicle and perpendicular to the tracks on which the vehicle is operated. Other beacon positions with regard to the end of the vehicle are also envisioned within the scope of the present disclosure. For example, in some embodiments, one beacon is at an end of a vehicle (in the "terminal plane") while a second beacon is offset from the terminal plane of the vehicle, either away from the vehicle, or between the terminal plane and the vehicle body. Horizontal offsets of beacons form the "terminal plane" of the vehicle incorporate additional information in coded signals transmitted between beacons to compensate for the horizontal offset when making distance calculations based on time of flight of the signals transmitted between beacons. Reducing the size of the offset distance ε decreases the influence of the different vehicle orientations on determining accurate inter-vehicle distance measurements, and in reaching convergence between measured and calculated inter-vehicle distances as described in method 1100, below.

In some embodiments, beacon height ranges from about 1 to about 4 meters, although other beacon heights (or beacon elevations) are within the scope of the present disclosure. Beacon heights less than about 1 meter are not common because the lower end of a vehicle body begins at about 1 m above the rail. Further, low beacon heights may sometimes be prone to signal blockage or interference due to elevation differences between sending and receiving beacons on different vehicles during rail operation. Beacon heights greater than about 4 meters are not anticipated to be in common use because some rail vehicles have sloped ends. In mounting a beacon on an end of the vehicle, placing the beacon as near as possible to the end of the vehicle reduces the computational complexity in measuring inter-vehicle distances. Beacons mounted on sloped vehicle ends pose additional complexity in compensating for the sloped surface when making inter-vehicle distance measurements.

For purposes of identifying beacons mounted on vehicles, a beacon's position (Left or Right) is determined by the position a beacon is in as the end of the vehicle on which the beacon is mounted is viewed. Thus, the left beacon on first end 102A is first beacon 102L1, and the right beacon on first end 102A is second beacon 102R1, where L indicates that the first beacon is on the left side, and R indicates that second beacon 102R1 is on the right side, and the numeral "1" indicates that the beacon is on the first end 102A of vehicle 102. Vehicle 102 has two additional beacons on second end 102B: third beacon 102L2, and fourth beacon 102R2. Third beacon 102L2 is a left beacon on the second end, and fourth beacon 102R2 is a right beacon on the second end. Third beacon 102L2 is at a third beacon elevation 102L2H, and fourth beacon 102R2 is at a fourth beacon elevation 102R2H. In FIG. 1B, first beacon elevation 102L1H and second beacon elevation 102R1H are the same elevation. In FIG. 1C, third beacon elevation 102L2H and fourth beacon elevation 102R2H are the same height. In some embodiments, the beacon elevations are the same for each beacon on the vehicle. In some embodiments, beacon elevations are different for each beacon. In FIG. 1C, third beacon 102L2 and fourth beacon 102R2 are a beacon separation distance (ω), or second separation distance 110B, from each other, and are symmetrically positioned on second end 102B with regard to vehicle centerline 112. Although two beacons are show in FIGS. 1B and 1C, in some embodiments, additional beacons are installed on the faces of vehicles in order to increase the accuracy of measuring inter-vehicle distances. In some embodiments, the additional beacons installed on a vehicle face are installed in a vertical orientation. In some embodiments, the additional beacons are installed in a horizontal orientation. The additional beacons do not need to be co-linear with the left and right beacons, as shown in FIG. 1B and FIG. 1C.

Figure 2B:
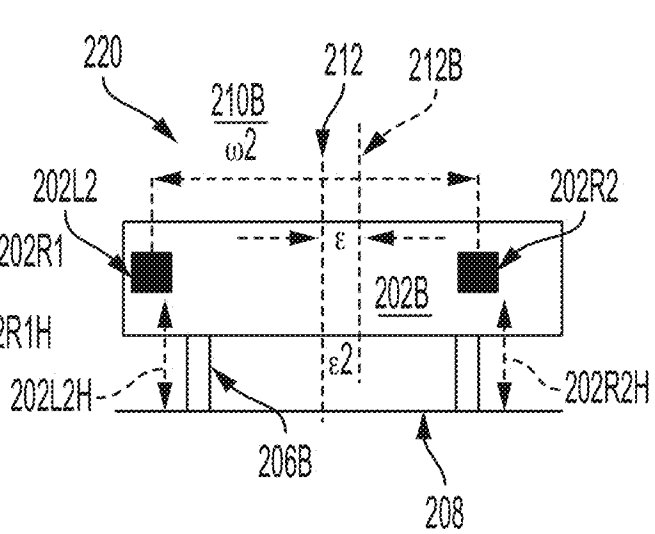
FIGS. 2A-2B are views of a vehicle with beacons, in accordance with some embodiments.
Figure 2A:
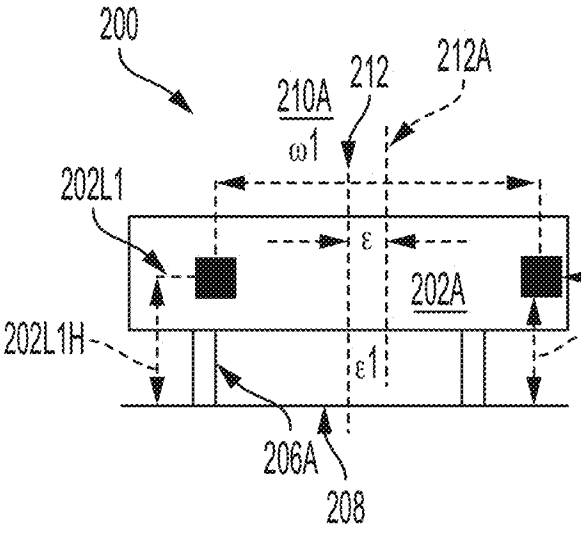

FIGS. 2A-2B are views of a vehicle with beacons, in accordance with some embodiments. FIG. 2A is an end view of a first end 202A of a vehicle 200, in accordance with some embodiments. Elements of FIG. 2A which are similar in description and function to the elements of FIG. 1B have a same identifying numeral, incremented by 100. On first end 202A, first beacon 202L1 is a left beacon, and second beacon 202R1 is a right beacon, with respect to vehicle centerline 212. First beacon 202L1 and second beacon 202R1 are a beacon separation distance ω1, or third separation distance 210A, apart from each other. However, unlike FIG. 1B, first beacon 202L1 and second beacon 202R1 are not symmetrically located on first end 202A, with respect to vehicle centerline 212. Rather, the beacon centerline between first beacon 202L1 and second beacon 202R1 is offset a first offset amount ε1, or first offset distance, from the vehicle centerline 212. Beacon centerline offset amounts range from 0 cm to about 50 cm, although other beacon centerline offset amounts are also contemplated in the present disclosure. Reducing the beacon centerline offset simplifies inter-beacon distance calculations. For commercially-available radar and/or beacon systems, beacon centerline offset distances of up to 50 cm provide accurate position measurements without introducing difficulties in measuring which track a vehicle is on. For beacon centerline offset distances of greater than 50 cm, track identification accuracy sometimes becomes inaccurate. For purposes of the present disclosure, offsets to the right side of a vehicle end are described as being "positive" offsets, and offsets to the left side of a vehicle are described as being "negative" offsets. Thus, first beacon 202L1 and second beacon 202R1 are asymmetrically positioned on first end 202A of vehicle 200.

FIG. 2B is a view of a vehicle 240 with beacons, in accordance with some embodiments. In FIG. 2B, elements which are similar in description and function to the elements of FIG. 1C have a same identifying numeral, incremented by 100. On second end 202B, the left beacon 202L2 and the right beacon 202R2 are separated by a beacon separation distance ω2 (beacon separation distance 210B), and the centerline 212B between the left beacon 212L2 and the right beacon 212R2 is offset a second offset amount ε2, or second offset distance. Second offset amount ε2 is a negative offset.

FIGS. 1A, 1B, and 1C, above, describe a vehicle where the beacons have no offset. In some embodiments, a vehicle has beacons on one end with no offset, and beacons on a second end with positive offset. In some embodiments, a vehicle has beacons on one end with no offset, and beacons on a second end with negative offset. In some embodiments, a vehicle has offset beacons on both ends. In some embodiments, each end of a vehicle has positively offset beacons. In some embodiments, each end of a vehicle has negatively offset beacons. In some embodiments, one end of a vehicle has positively offset beacons and the other end of the vehicle has negatively offset beacons. Further discussion of beacon offsets between uncoupled vehicles during obstacle avoidance and/or localization is presented below in for FIGS. 4A and 4B.

Figure 3A:
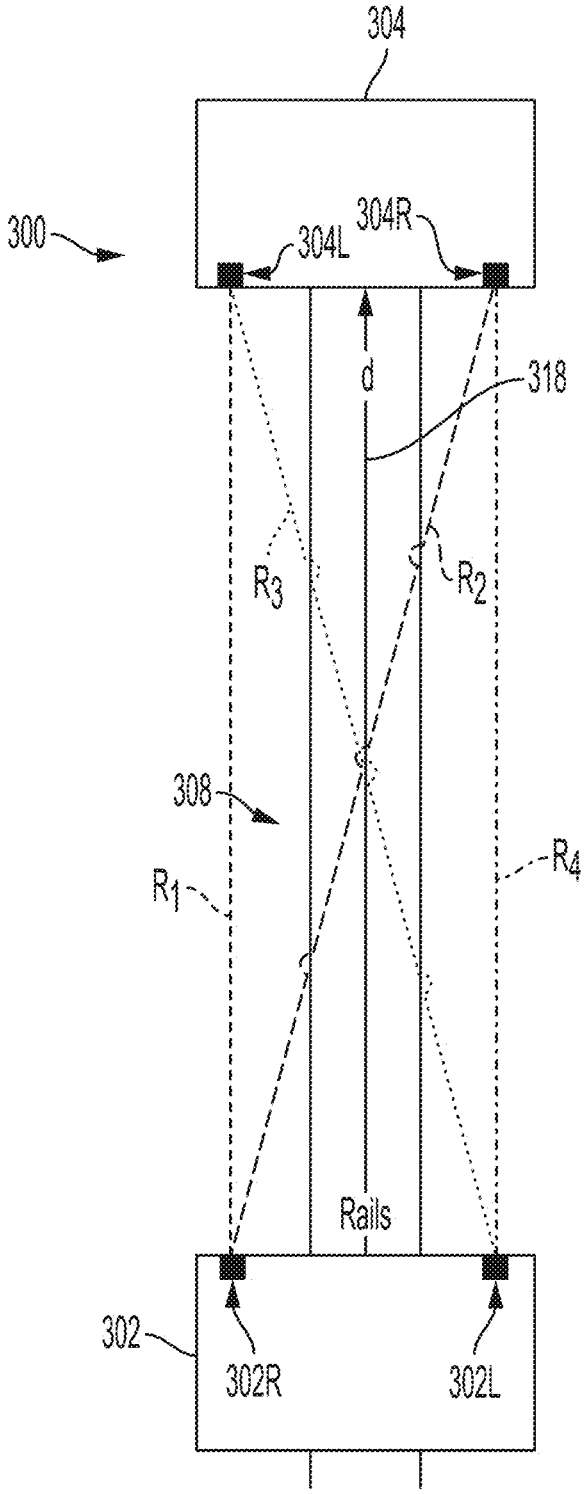
FIGS. 3A-3B are top views of vehicles during obstacle avoidance, in accordance with some embodiments.
Figure 3B:
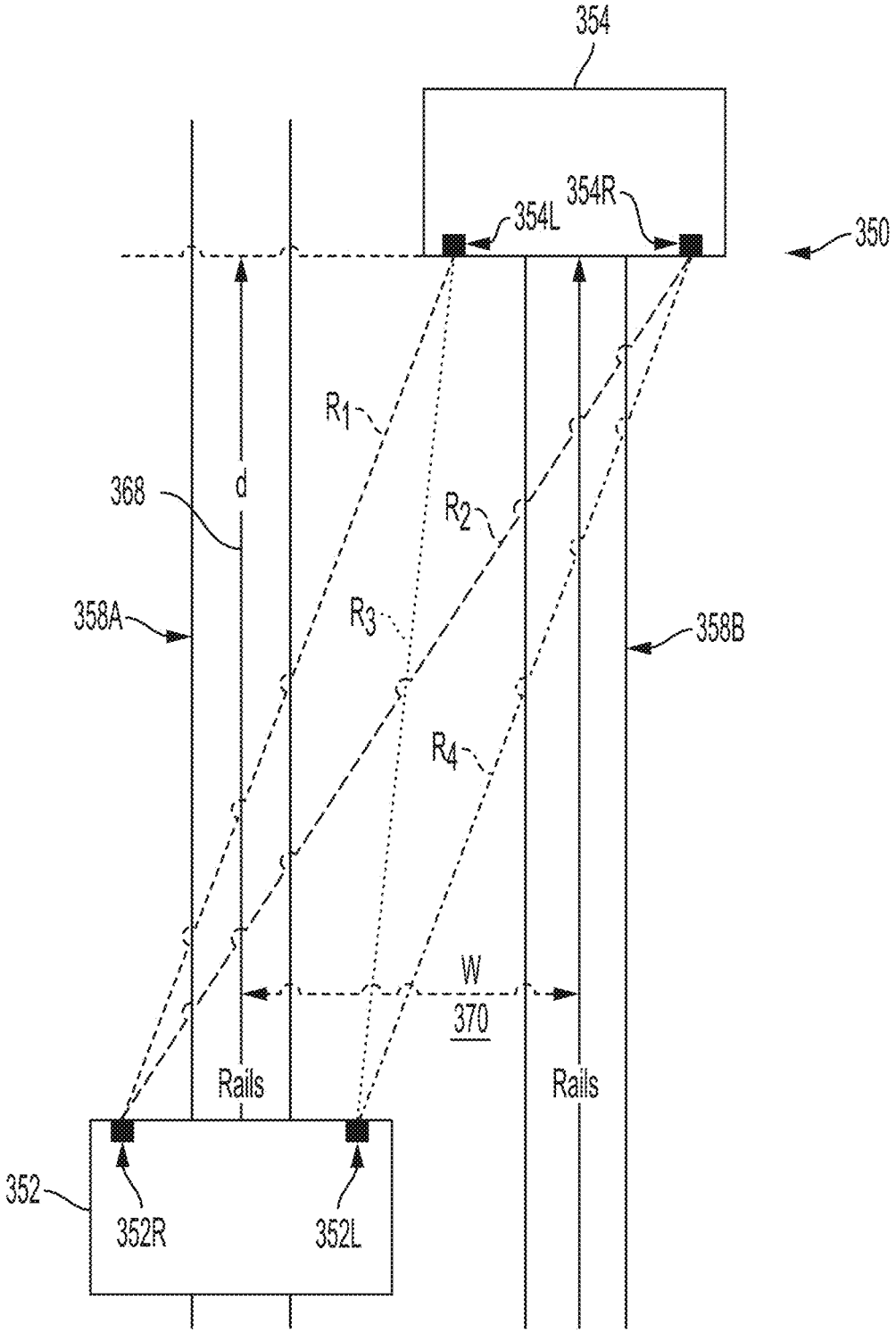

FIGS. 3A-3B are top views of vehicles during obstacle avoidance, in accordance with some embodiments. FIG. 3A is a top view of a first vehicle configuration 300 with a vehicle 302 and a vehicle 304. In FIG. 3A, a vehicle 302 and a vehicle 304 are on straight, horizontal track 308 with no grade. In first track operation scenario, a vehicle 302 is positioned at a distance D1 (inter-vehicle distance 318) along a same track, track 308. Vehicle 302 has a left beacon 302L and right beacon 302R, and vehicle 304 has a left beacon 304L and a right beacon 304R. A distance R1 (first beacon distance) is measured between left beacon 304L on vehicle 304 and right beacon 302R on vehicle 302. A distance R2 (second beacon distance) is measured between right beacon 302R on vehicle 302 and right beacon 304R on vehicle 304. A distance R3 (third beacon distance) is measured between left beacon 302L on vehicle 302 and left beacon 304L on vehicle 304. A distance R4 (fourth beacon distance) is measured between left beacon 302L on vehicle 302 and right beacon 304R on vehicle 304. Distances R2 and R3 are larger than distances R1 and R4 in first track operation scenario 300 because both vehicles are on track 308 and the portion of track 308 between vehicle 302 and vehicle 304 is straight. As is discussed below, the distances R1–R4 are used to calculate an inter-vehicle distance 318 (distance d). In some embodiments, beacons fastened to a vehicle of interest are called internal beacons, and beacons attached to a different vehicle, or to a fixed location with respect to the track, are called external beacons.

In some arrangements the ranges provided by the right beacon (R1 and R2) of the vehicle of interest, and the ranges provided by the left beacon (R3 and R4) of the vehicle interest, are augmented by the following information associated with the other vehicle associated with these measurements: the vehicle end (beacon) diagraph position, the vehicle end (beacon) leading/trailing state. In some arrangements, the obstacle avoidance computer is configured with the following parameters: beacon separation distance, ω; Wmin (minimum track separation amount); Rmin (minimum beacon separation amount); a guideway map in Diagraph topology; horizontal radii of curvature for each position on the diagraph; track grade for each position on the diagraph; grade change (vertical radii of curvature) for each position on the diagraph; lateral distance (center-to-center) to the nearest parallel tracks to the right; lateral distance (center-to-center) to the nearest parallel tracks to the left; lateral distance (center-to-center) to the second, third, etc. nearest parallel tracks to the right; and lateral distance (center-to-center) to the second, third, etc. nearest parallel tracks to the left.

FIG. 3B is a top view of a vehicle 352 and a vehicle 354 during a second track operation scenario 350. Elements of second track operation scenario 350 which are similar in function and description as elements of first track operation scenario 300 have a same identifying numeral incremented by 50. Vehicle 352 is on track 358A, and vehicle 354 is on track 358B. Track 358A is separated from track 358B by a distance W (a center-to-center inter-track distance 370). According to some embodiments, the smallest value of W is the width of the rail vehicle itself, with no clearance between vehicles on adjacent tracks. In typical rail operation, W has a value ranging from about 4 meters to about 6 meters. Because vehicle 352 is on track 358A, and vehicle 354 is on track 358B, R1 is larger than R3, and R2 is larger than R4. Vehicle 354 is separated, in a direction along the tracks 358A and 358B, from vehicle 352 by a distance d (inter-vehicle distance 368).

Figure 4B:
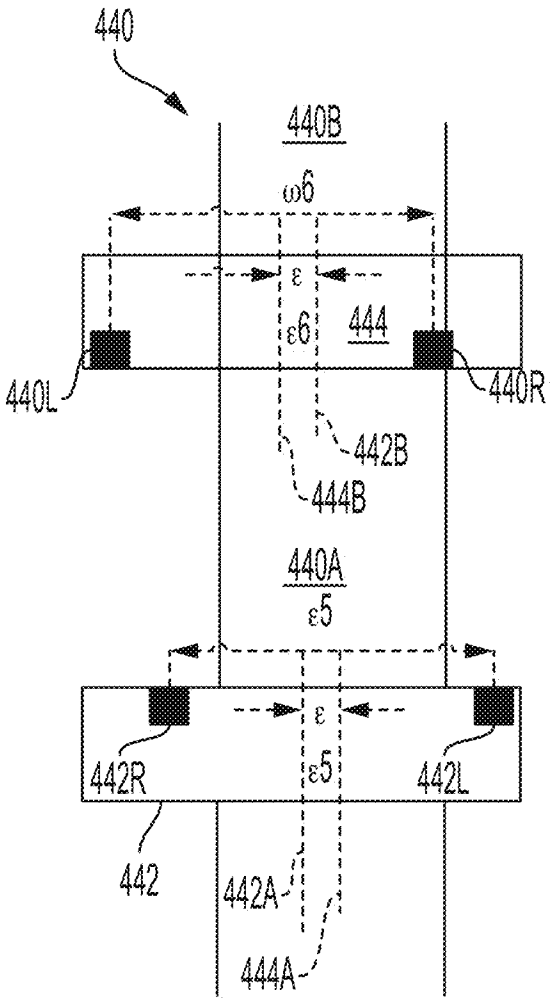
FIGS. 4A-4B are top views of vehicle orientations during rail operation, in accordance with some embodiments.
Figure 4A:
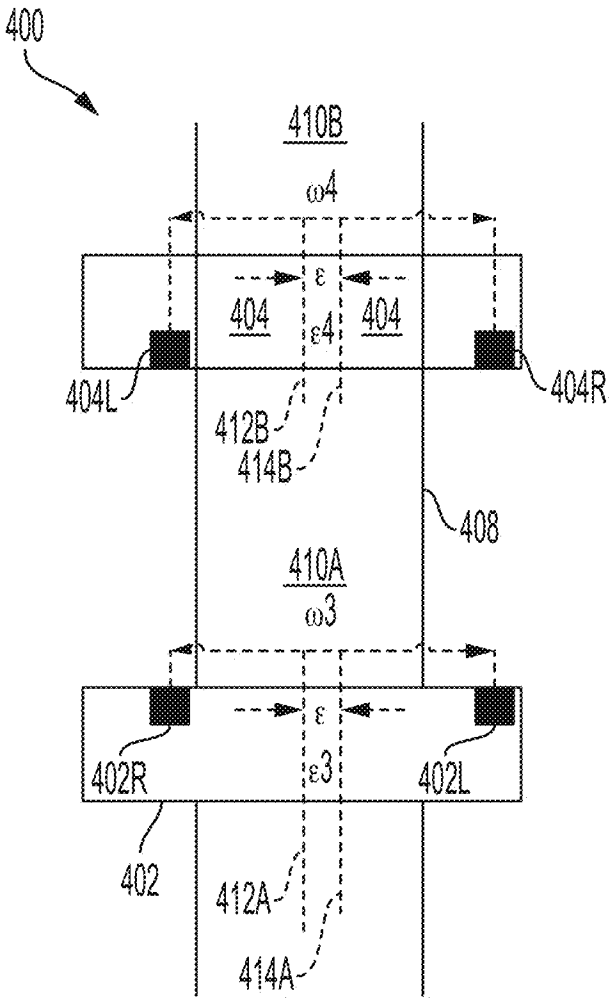

FIG. 4A is a top view of a vehicle configuration 400 during rail operation, in accordance with some embodiments. In vehicle configuration 400, a vehicle 402 has a left beacon 402L and a right beacon 402R, separated by a beacon separation distance ω3 (beacon separation distance 410A). The beacon centerline 414A for left beacon 402L and right beacon 402R is offset from the vehicle centerline 412A of vehicle 402 by an offset amount ε3. Vehicle 404 has a left beacon 404L and a right beacon 404R. Beacon centerline 414B is offset from the vehicle centerline 412B for vehicle 404 by an offset amount ε4. Left beacon 404L and right beacon 404R are separated by a beacon separation distance ω4 (beacon separation distance 410B). The pairs of beacons for vehicles 402 and 404 are offset in a same direction with regard to track 408: beacons 402L and 402R are offset in a negative direction, and beacons 404L and 404R are offset in a positive direction. Thus, in vehicle configuration 400, vehicle 402 and vehicle 404 have a same orientation because the pairs of beacons are offset in the same direction with respect to the centerline of the track. For purposes of the present disclosure, the term "vehicle orientation" is used to describe orientations of beacons on ends of pairs of vehicles in a vehicle configuration. The term "vehicle configuration" is used to describe positions of vehicles on tracks (leading vehicle, trailing vehicle, same track, different tracks, and the position of the other vehicle with respect to the vehicle of interest (e.g., on a track to the left, or a track to the right, of the track where the vehicle of interest is located)).

FIG. 4B is a top view of a vehicle configuration 440 during rail operation, in accordance with some embodiments. Elements of FIG. 4B which correspond in function and description to elements of FIG. 4A, described above, have a same identifying numeral, incremented by 40. Elements of FIG. 4B which differ in description or function from the elements of FIG. 4A are further described below. Left beacon 440L and right beacon 440R of vehicle configuration 440 have a negative offset (e.g., to the left of the end of the vehicle where the beacons are mounted), unlike the beacons of vehicle 404 in FIG. 4A, which have a positive offset (e.g., to the right of the end of the vehicle where the beacons are mounted). Thus, in vehicle configuration 440, vehicle 402 and vehicle 404 have an opposite orientation because the pairs of beacons are offset in different directions with respect to the centerline of the track. Further discussion of calculating values for inter-beacon distances based on whether the vehicle beacons have same or opposite orientations is presented below.

Beacons which transmit and receive information regarding the beacon position on the face of the vehicle are configured to present information regarding such "symmetrically offset" (see FIG. 4A) or "asymmetrically offset" (see FIG. 4B) beacon configurations on uncoupled vehicles during rail operations. The degree of beacon centerline offset, and the beacon separation distances on the end of each vehicle, modifies the distances R1–R4 measured by the beacons during obstacle avoidance and vehicle localization. While some vehicles on a railway have similar beacon separation distances, and similar beacon elevations with respect to the track below the vehicle, some variation is anticipated and accounted for in the present disclosure by having each beacon programmed with beacon elevation and lateral beacon position information (e.g., position with regard to the vehicle centerline, reflected in the magnitude and direction of ε, and the beacon separation for each pair of beacons on vehicles) to ensure proper calculation of inter-vehicle separation distances, despite occasional asymmetry of beacon installation on vehicle ends.

Figure 5:
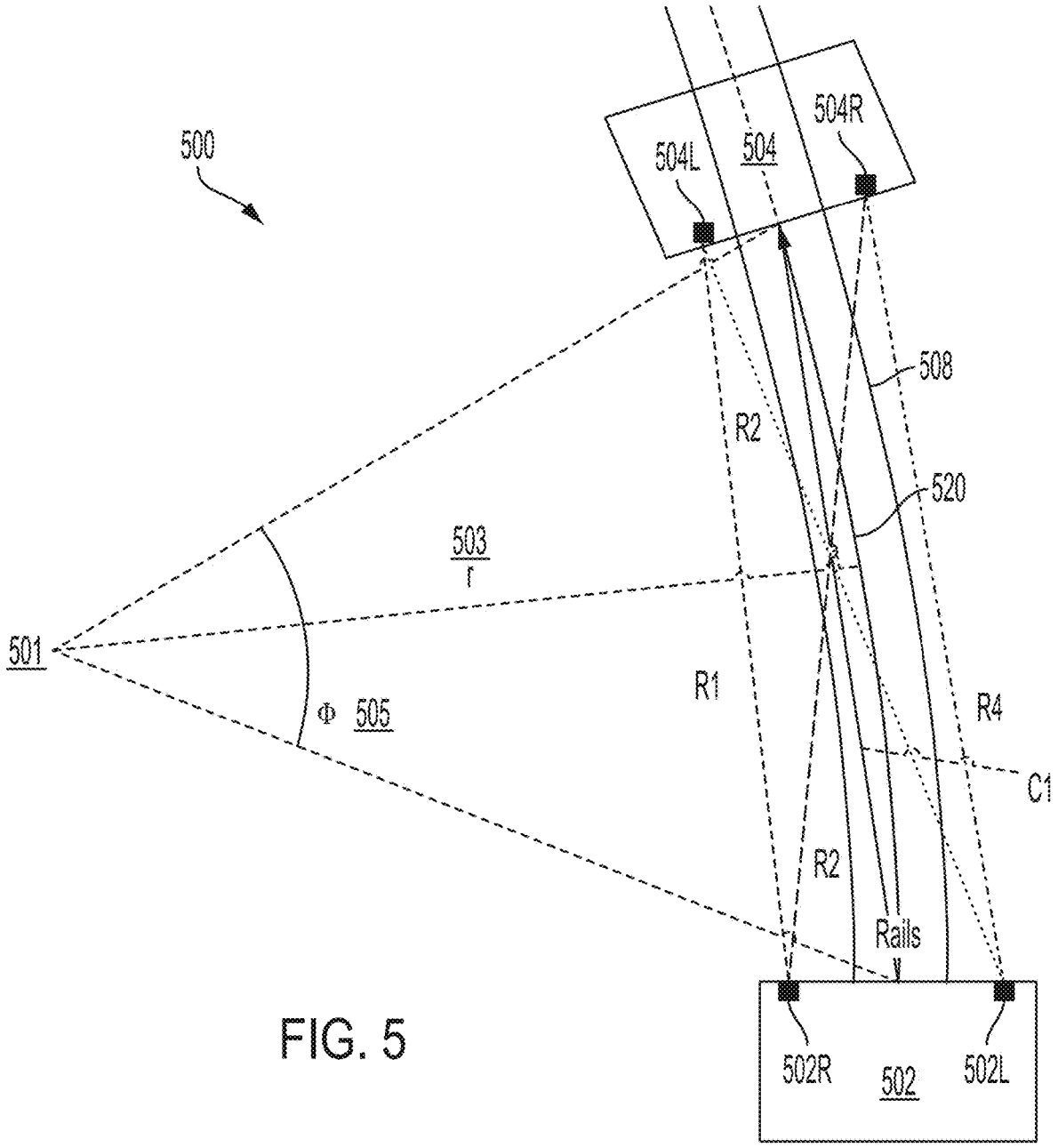
FIG. 5 is a top view of a single track vehicle configuration during obstacle avoidance, in accordance with some embodiments.

FIG. 5 is a top view of a vehicle configuration 500 during obstacle avoidance, in accordance with some embodiments. Vehicle configuration 500 is a single-track vehicle configuration with two vehicles on the same track. In vehicle configuration 500, a vehicle 502 and a vehicle 504 are on a same curved track, track 508. A centerpoint 501 (of a radius of curvature of the tracks) is associated with the position of a vehicle on the tracks. R1–R4 are measured between left beacon 502L and right beacon 502R of vehicle 502 and left beacon 504L and right beacon 504R of vehicle 504. Inter-vehicle distance 520 (d) is determined by averaging the values of R1 and R4 as follows: d=(R1+R4)/2. Chord C1 is the inter-vehicle distance as determined from the measurements of R1–R4. Radius 503 (r) is the radius of curvature of track 508, which ranges up to a value of 250 meters. In some embodiments of vehicles, the wheel carriage, or bogie, of a vehicle retains the vehicle on the tracks as the vehicle rolls along the tracks. Wheel carriages, or bogies, are typically located 20 meters apart on a vehicle, and are configured to rotate about an axis to the left and right to accommodate turns along the tracks. A bogie is typically configured to rotate to up to about 10° to the left, or up to about 10° to the right, from a "straight" orientation on tracks. A radius of curvature of about 250 meters for a curved section of track represents a tight turn for a vehicle traveling on rails. While radii of curvature smaller than 250 meters are also included within the scope of the present disclosure, for common commercial rail vehicles in many nations, the radius of curvature r does not extend below the 250 meter value described herein as a smallest radius of curvature for normal rail operations of a vehicle. Arc length 520 is the length of the curve of track 508 extending between the vehicle 502 and the vehicle 504. Angle 505 (φ) is the central angle described by the radius from centerpoint 501 to vehicle 502 (or, to the centerline of the vehicle end) and the radius from centerpoint 501 to vehicle 504 (or, to the centerline of the vehicle end).

Figure 6:
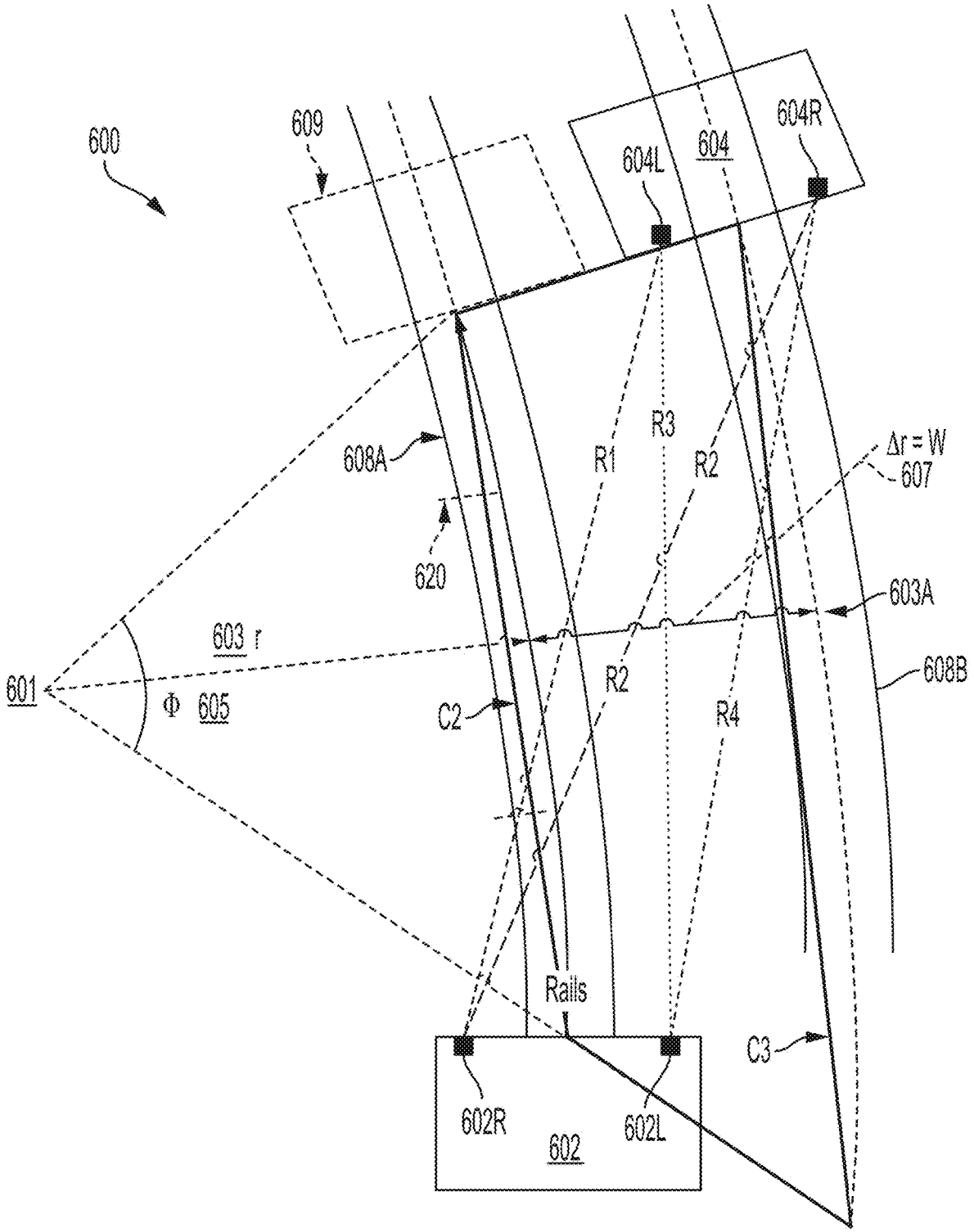
FIG. 6 is a top view of a dual-track vehicle configuration during obstacle avoidance, in accordance with some embodiments.

FIG. 6 is a top view of a vehicle configuration 600 during obstacle avoidance, in accordance with some embodiments. Vehicle configuration 600 is a dual-track configuration, where vehicle 602 is on track 608A (the left track) and vehicle 604 is on track 608B, the right track. Centerpoint 601 is a center of the curvature of track 608A and track 608B. Radius 603 (r) is a radius of curvature for track 608A with respect to the centerpoint 601. Angle 605 (φ) is the central angle between the radius extending from vehicle 602 to the centerpoint 601, and the position that vehicle 604 would occupy on track 608A, based on the measurements of R1–R4. A track separation width 607 (W) is equal to the difference between the radius 603 for track 608A and the radius 603A (r+W, or r+Δr) for track 608B. Δr is the radius difference between the tracks the vehicle of interest resides on and the tracks the other vehicle resides on. Δr equals W for the straight tracks. Chord C2 is an inter-vehicle distance between the vehicle 602 and the calculated position of vehicle 604 on track 608A, based on measured values R1–R4. Chord C3 is an inter-vehicle distance based on the measured position of the vehicle 604 on track 608B, and the extrapolated position of vehicle 602 on track 608B, based on the measured values of R1–R4. Arc length 620 is the length of track 608A between the position of vehicle 602 and the extrapolated position of vehicle 604 on track 608A (e.g., position 609), based on the measured values of R1–R4. R1 is the measured distance between right beacon 602R and left beacon 604L. R2 is the measured distance between right beacon 602R and right beacon 604R. R3 is the measured distance between left beacon 602L and left beacon 604L. R4 is the measured distance between left beacon 602L and right beacon 604R. In vehicle configuration 600, R1 is smaller than R2, and R3 is smaller than R4.

Figure 7:
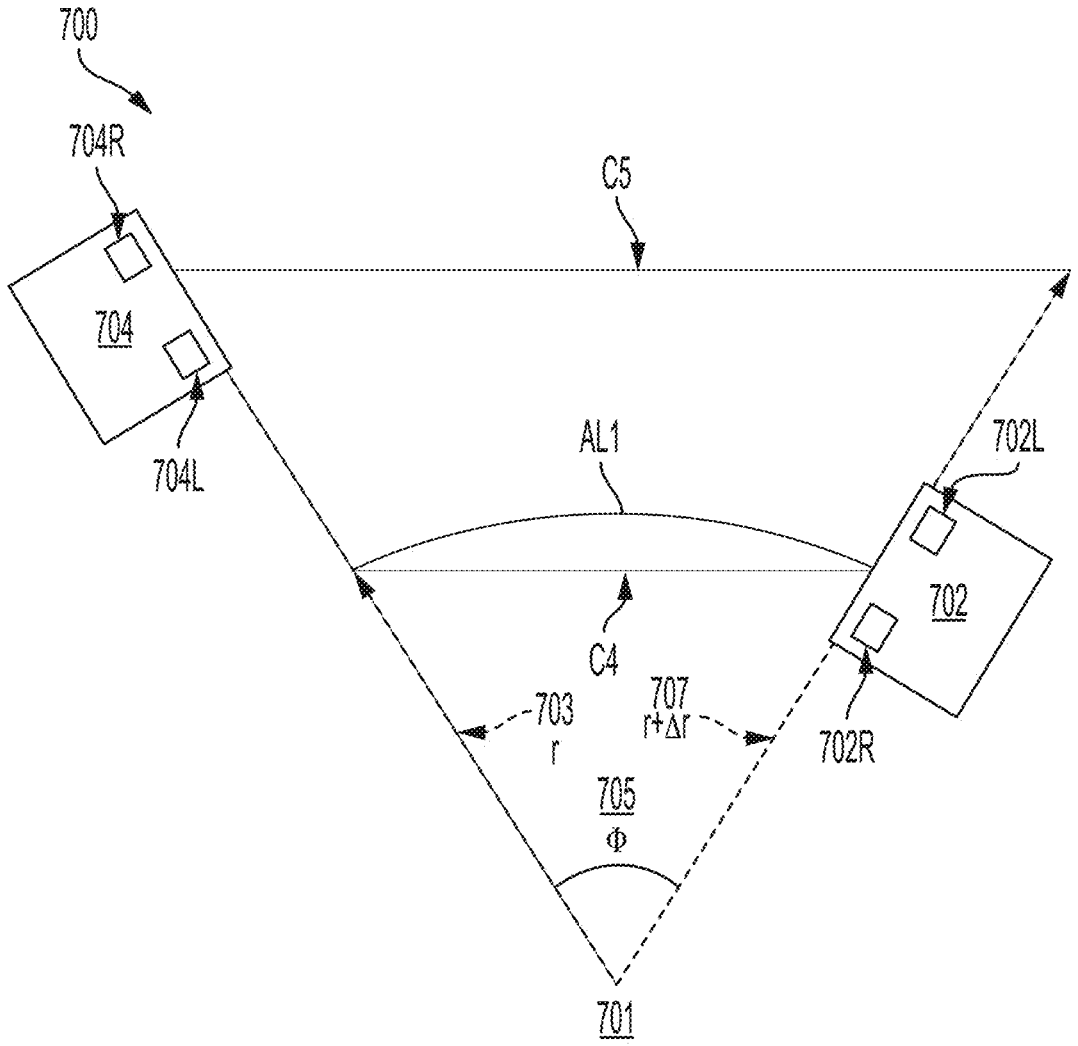
FIG. 7 is a schematic diagram of a dual-track vehicle configuration during obstacle avoidance, in accordance with some embodiments.

FIG. 7 is a schematic diagram of a dual-track vehicle configuration 700, in accordance with some embodiments. In dual-track vehicle configuration 700, a centerpoint 701 is calculated for the radius of curvature of vehicle 702 and vehicle 704. Vehicle 702 is on a first/inner track (not shown, for clarity), and vehicle 704 is on a second/outer track (not shown) which is parallel to the first track. Central angle 705 (φ) is the angle between the radius 703 (r) and the radius 707 (r+Δr). As vehicle 702 travels the first track, the first vehicle will traverse a distance described by the arc length AL1, from an initial position (shown) at one end of chord C4 along radius 707 (r+Δr), to a final position (not shown) along radius 703 (r). Vehicle 702 has left beacon 702L and 702R, and vehicle 704 has left beacon 704L and right beacon 704R. Chord C5 describes a calculated distance between the actual (initial) position of vehicle 704 (shown) and a calculated position of vehicle 702 on the second track (not shown) where vehicle 704 is located. Chord C5 represents the inter-vehicle distance for vehicles on the same outer/second track, and chord C4 represents the inter-vehicle distance for vehicles on the same inner/first track. Distances R1–R4 are measured and used to calculate an inter-vehicle distance, which is then compared to the magnitude of chords C4 and C5. When the actual inter-vehicle distance measured between vehicle 702 and vehicle 704 matches one of chords C4 or C5, the vehicles are determined to be on the same track in preparation for activating an obstacle avoidance protocol (e.g., emergency braking, and so forth, as described below in Method 1100 and Method 1200).

The methods presented in the present disclosure include comparing the differences between the inter-beacon distances, namely: (1) R2 and R1 (R2–R1), (2) R3 and R2 (R3–R2), (3) R3 and R1 (R3–R1), (4) R3 and R4 (R3–R4), (5) R2 and R4 (R2–R4), and (6) R4 and R1 (R4–R1).

Figure 8A:
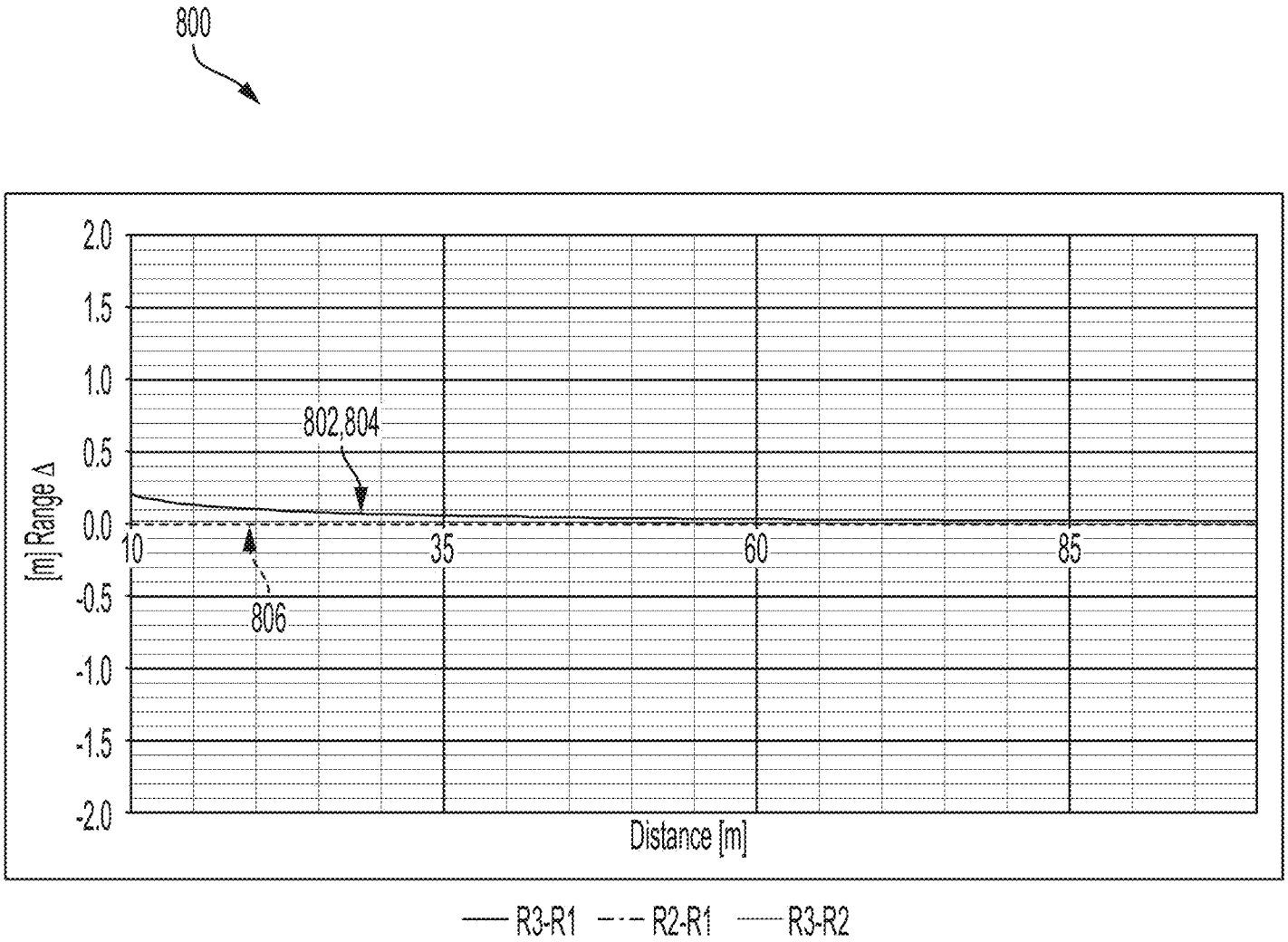
FIGS. 8A-8F are charts of inter-beacon distances during rail operation, in accordance with some embodiments.

FIG. 8A is a chart 800 of inter-beacon distances during rail operation, in accordance with some embodiments. For each of charts 800, 820, 840, 860, 880, and 890, inter-beacon distance calculations are drawn as a function of inter-vehicle distance (d) based on the following conditions: [1] R3–R4–R2–R1 (the beacons are symmetrically mounted on the ends of the two vehicles), [2] R2–R4–R3–R1 (a second indication that the beacons are symmetrically mounted on the ends of the two vehicles), [3] R4–R1=0 (a third indication that the beacons are symmetrically mounted on the ends of the two vehicles), [4] $2\varepsilon \ll \omega$, [5] W=5 meters, and [6], r=250 meters (for charts 860, 880, and 890, below, based on curved tracks). For each chart, the x-axis describes the values of inter-vehicle distances d, and the y-axis represents the differences between measured inter-beacon distances as described below.

Chart 800 is based on the condition that the vehicle of interest and the other vehicle are on a same stretch of straight track. In chart 800, the plotted trace 802 represents the value of R3–R1 as a function of inter-vehicle distance (d), plotted trace 804 represents the value of R2–R1 as a function of inter-vehicle distance (d), and plotted trace 806 represents the value of R3–R2 as a function of inter-vehicle distance (d). Plotted trace 806 remains flat at ΔR=0 meters for all distances d on chart 800, and the plotted traces 802 and 804 overlay each other for all distances d on chart 800.

Figure 8B:
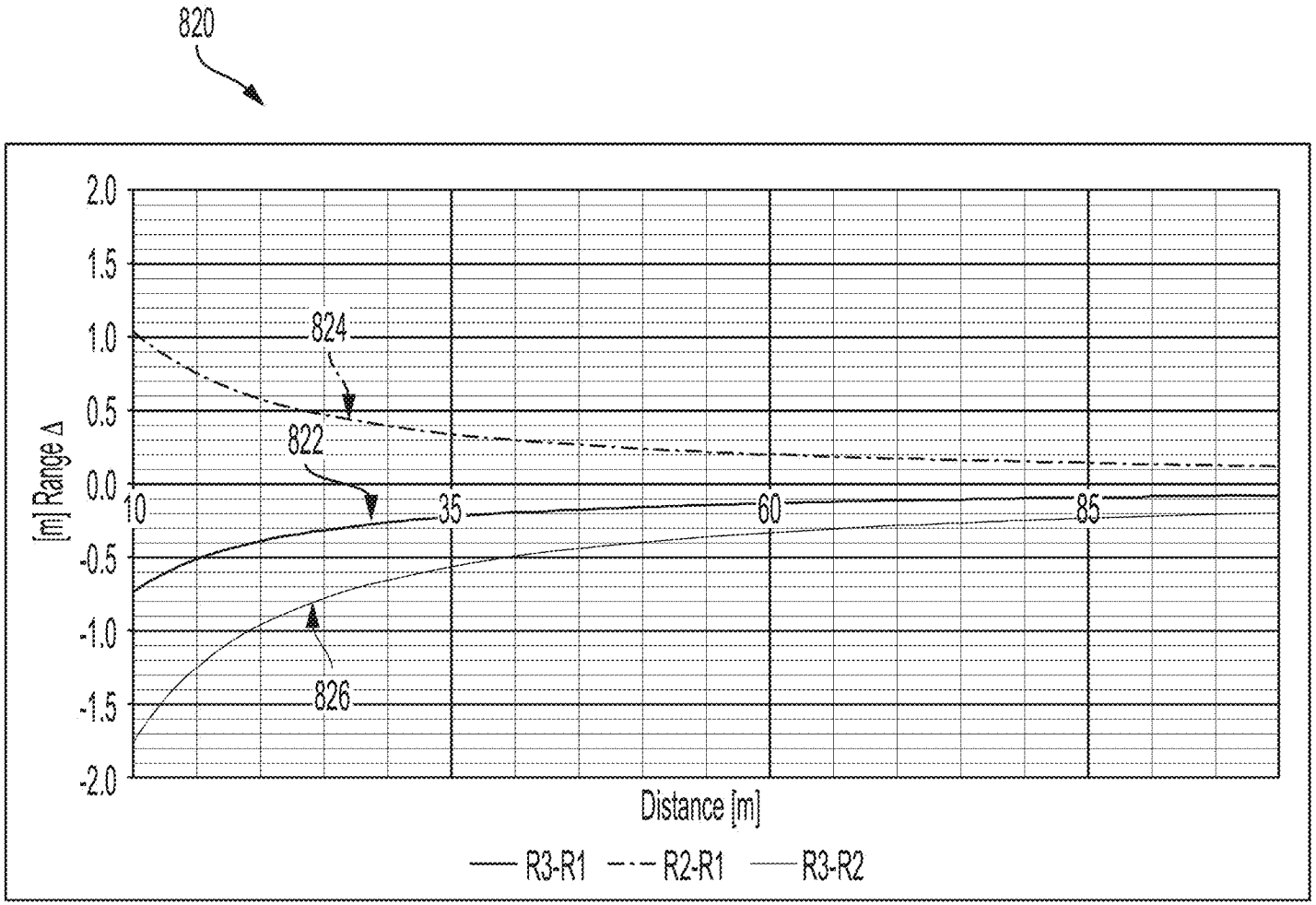

FIG. 8B is a chart 820 of inter-beacon distances during obstacle avoidance, in accordance with some embodiments. Chart 820 is based on the condition that the vehicle of interest and the other vehicle are on adjacent, parallel, straight tracks, the vehicle of interest (see, e.g., vehicle 352 in FIG. 3B) being on the left of the other vehicle (see, e.g., vehicle 354 of FIG. 3B). In chart 820, the plotted trace 822 represents the value of R3–R1 as a function of inter-vehicle distance (d), plotted trace 824 represents the value of R2–R1 as a function of inter-vehicle distance (d), and plotted trace 826 represents the value of R3–R2 as a function of inter-vehicle distance (d). In Chart 820, plotted trace 822 for R3–R1<0 and increases asymptotically for all values of d, while plotted trace 824 for R2–R1>0 and decreases asymptotically for all values of d. Plotted trace 826 for R3–R2 is <0, and for each value of d, R3–R2 is smaller than R3–R1.

Figure 8C:
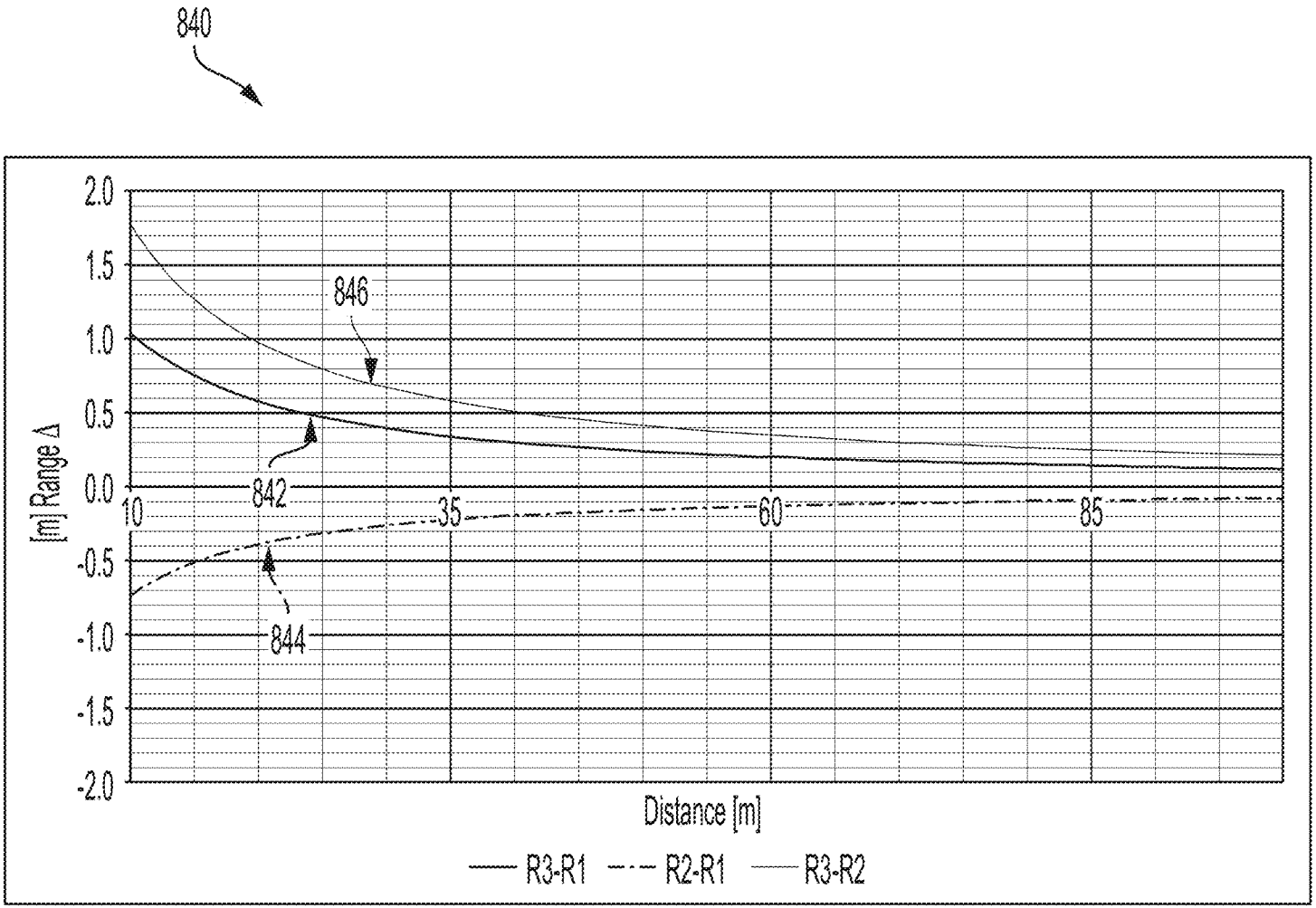

FIG. 8C is a chart 840 of inter-beacon distances during obstacle avoidances, in accordance with some embodiments. Chart 840 is based on the condition that the vehicle of interest and the other vehicle are on adjacent, parallel, straight tracks, the vehicle of interest being on the right of the other vehicle. In chart 840, the plotted trace 842 represents the value of R3–R1 as a function of inter-vehicle distance (d), plotted trace 844 represents the value of R2–R1 as a function of inter-vehicle distance (d), and plotted trace 846 represents the value of R3–R2 as a function of inter-vehicle distance (d). In chart 840, plotted trace 842 is >0 and decreases for all values of d, plotted trace 844 is <0 and increases for all values of d, and plotted trace 846 is >0 and larger than the corresponding value (for a given value of d) R3–R1 for each value of d.

Figure 8D:
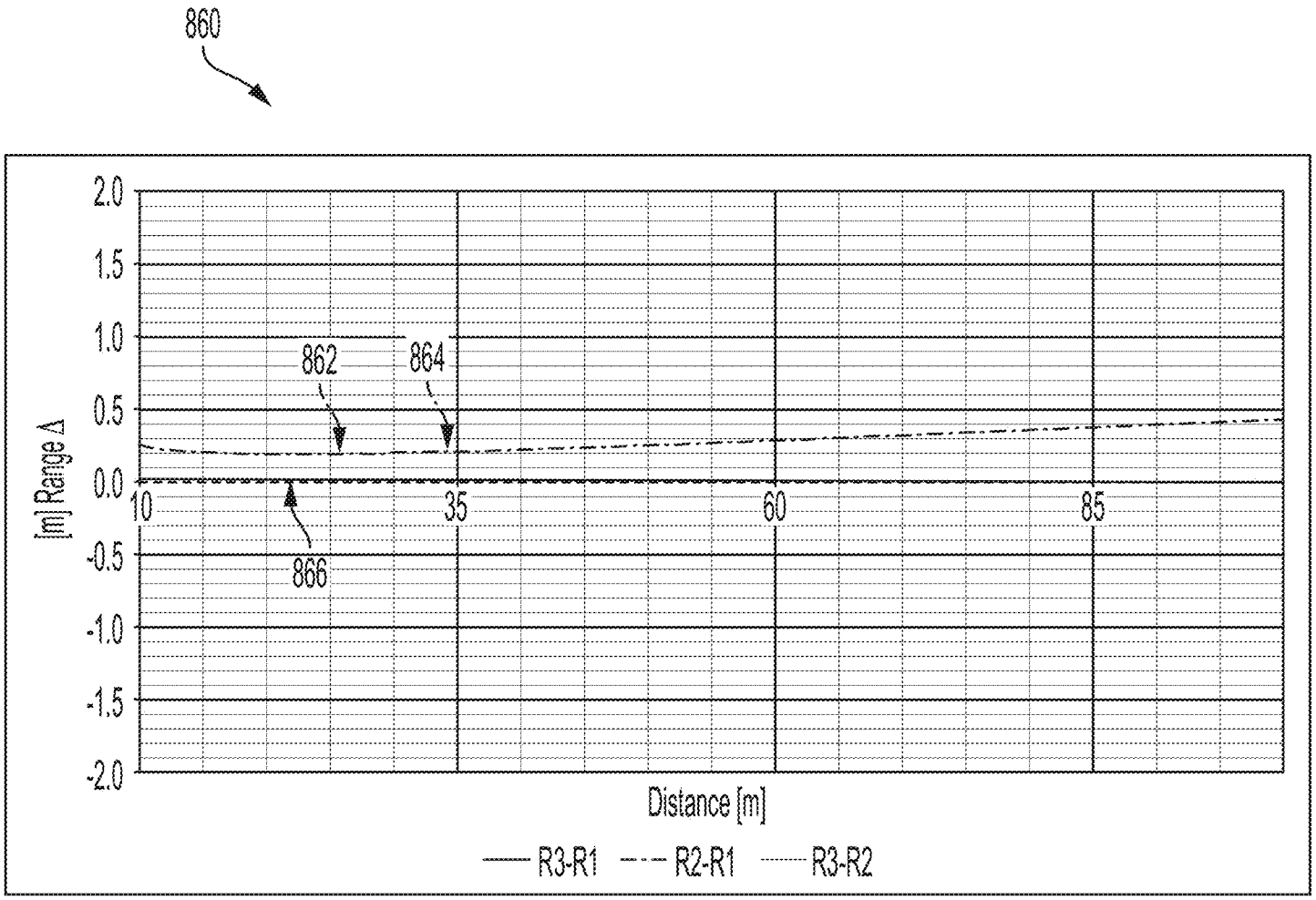

FIG. 8D is a chart 860 of inter-beacon distances during obstacle avoidances, in accordance with some embodiments. Plotted traces for chart 860 are generated for vehicle configurations having the vehicle of interest and the other vehicle on a same curved stretch of track. In chart 860, the plotted trace 862 represents the value of R3–R1 as a function of inter-vehicle distance (d), plotted trace 864 represents the value of R2–R1 as a function of inter-vehicle distance (d), and plotted trace 866 represents the value of R3–R2 as a function of inter-vehicle distance (d). In chart 860, the plotted trace 842 represents the value of R3–R1 as a function of inter-vehicle distance (d), plotted trace 844 represents the value of R2–R1 as a function of inter-vehicle distance (d), and plotted trace 846 represents the value of R3−R2 as a function of inter-vehicle distance (d).

For chart 860, plotted trace 862 and plotted trace 864 overlay each other and are greater than zero for all plotted values of d. Plotted trace 866 shows that the difference between R3 and R2, (R3−R2) is practically zero (e.g., R3−R2~0) for all plotted values of d. In an embodiment, also described above, the following assumptions are made in order to approximate the plotted traces of chart 860: beacons are mounted symmetrically on the end faces of each vehicle, resulting in: (R3−R4)=(R2−R1), and (R2−R4)=(R3−R1), and (R4−R1)=0; the offset amounts of centerlines between beacons are significantly smaller than the beacon separation distances (e.g., $2\varepsilon \ll \omega$), where $\omega=2$ meters, inter-track distance W=5 meters, and the track radius of curvature r=250 meters.

Figure 8E:
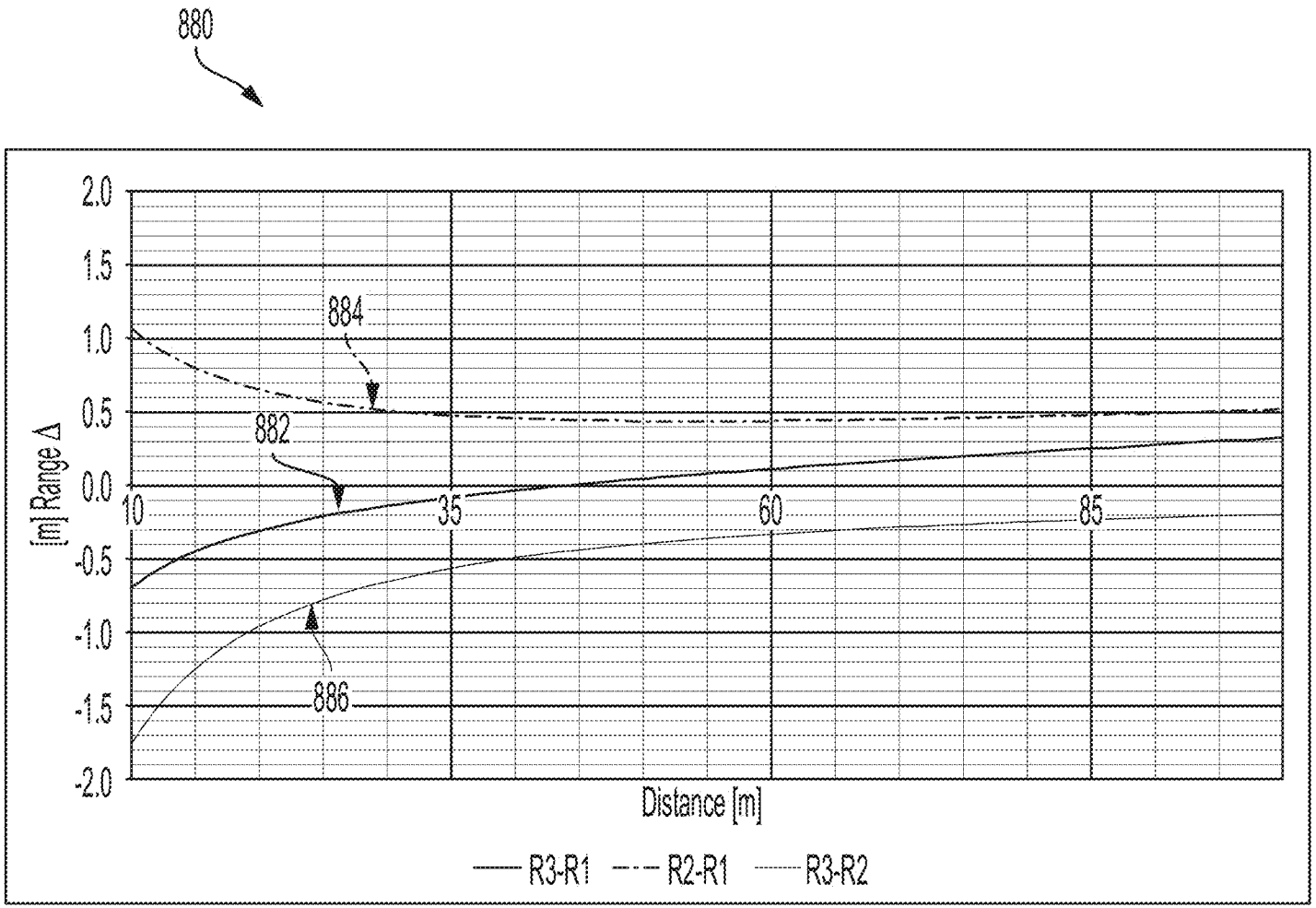

FIG. 8E is a chart 880 of inter-beacon distances during obstacle avoidances, in accordance with some embodiments. Chart 880 is based on the condition that each vehicle is on a curved track, and the vehicle of interest approaches the other vehicle from the left, on a first curved track, and that the other vehicle is on a second curved track "outside," or farther from the center of curvature of the two curved tracks. For clarification, see FIG. 6, track 608A as an example of an "inner" track, and track 608B as an example of an "outer" track.

In chart 880, plotted trace 882 for R3−R1 begins <0 and transitions to >0 midway across the chart. For plotted trace 884 for R2−R1, the trace is greater than 0 for all values of d, and decreases until approximately the value of d where plotted trace 882 crosses the x-axis (R3−R1=0), where plotted trace 884 begins to increase in conjunction with increasing values of plotted trace 882. Plotted trace 886 for R3−R2 is <0 for all values of d plotted on chart 880.

Figure 8F:
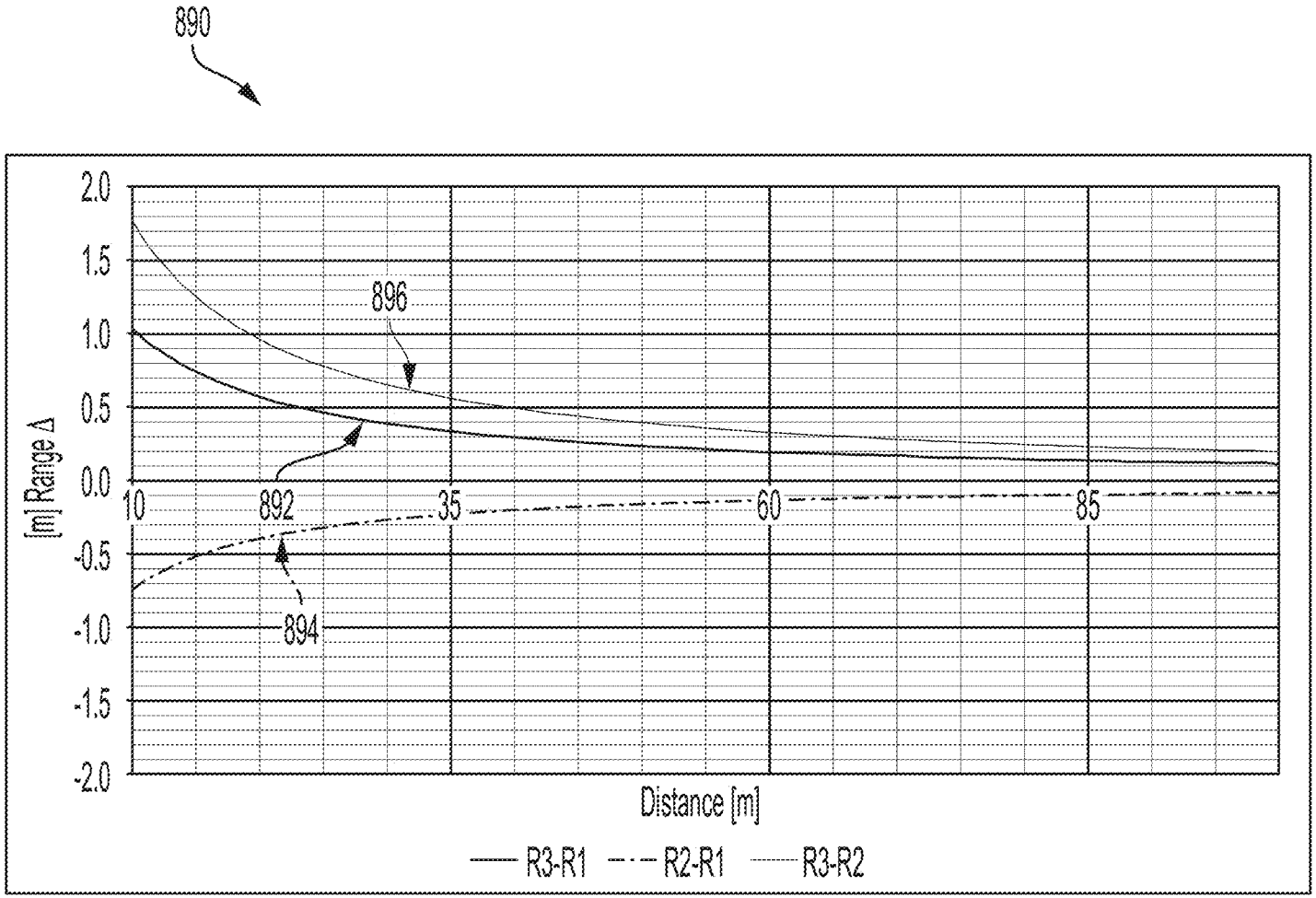

FIG. 8F is a chart 890 of inter-beacon distances during obstacle avoidances, in accordance with some embodiments. Chart 890 is based on the condition that each vehicle is on a curved track, and the vehicle of interest approaches the other vehicle from the right, on a first curved track, and that the other vehicle is on a second curved track "inside," or closer to the center of curvature of the two curved tracks.

In chart 890, plotted trace 892 for R3−R1 is positive for all values of d and decreases with increasing values of d. Plotted trace 894 for R2−R1 is <0 and increases for all values of d. Plotted trace 896 for R3−R2 is larger than 0 for all values of d, and decreases as d increases, at a greater rate than plotted trace 894 increases with increasing values of d.

In summary, for FIGS. 8A-8F, when R3−R2=0 and R3−R1=R2−R1, the inter-beacon distances indicate that the vehicle of interest and the other vehicle reside on the same tracks straight or curved.

For FIGS. 8A-8F, when R3−R2<R3−R1<R2−R1, such that R3−R2<0, R2−R1>0, and R3−R1>0, the inter-beacon distances indicate that the vehicle of interest and the other vehicle are on different tracks (parallel tracks), and that the other vehicle is to the right of the track where the vehicle of interest is located, whether the tracks are straight or curved.

When R2−R1<R3−R1<R3−R2, such that R3−R2>0, R2−R1<0 and R3−R1<0 the inter-beacon distances indicate that the vehicle of interest and the other vehicle are on different tracks (parallel tracks), and that the other vehicle is on a track to the left of the track where the vehicle of interest is located, whether the tracks are straight or curved.

Figure 9:
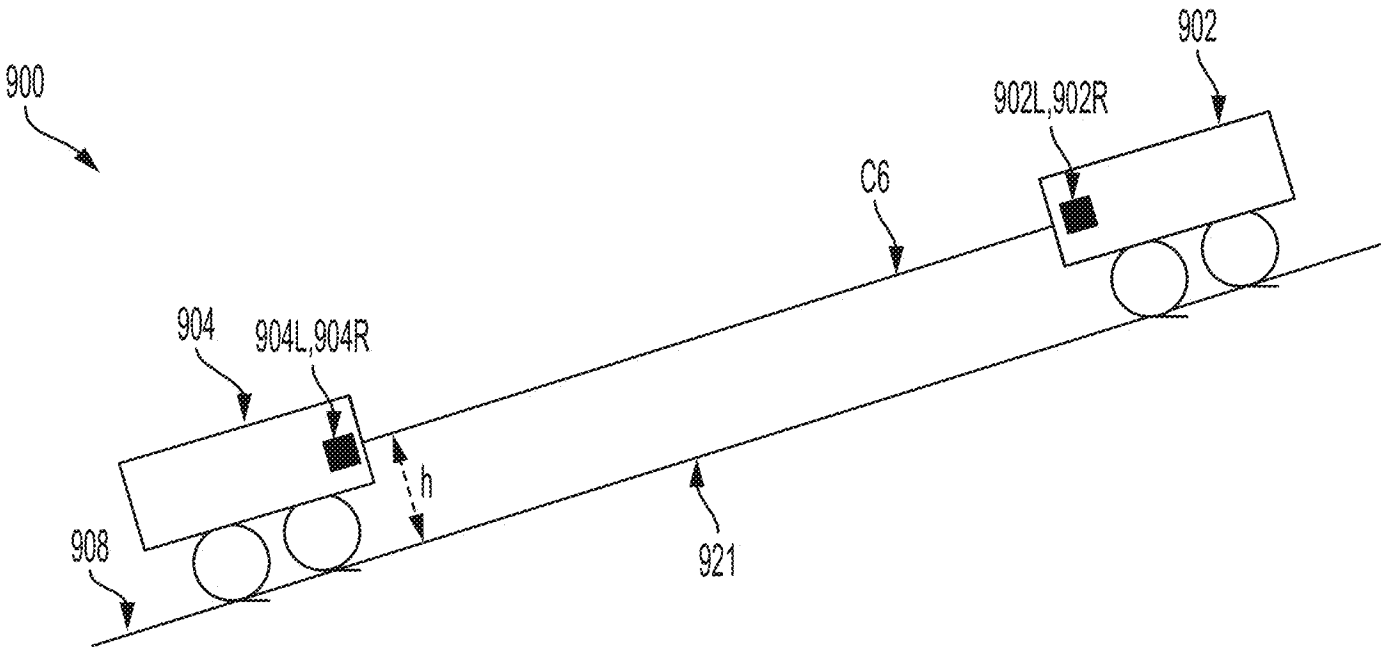
FIG. 9 is a diagram of a vehicle configuration during obstacle avoidance, in accordance with some embodiments.

FIG. 9 is a diagram of a vehicle configuration 900 during obstacle avoidance, in accordance with some embodiments. Vehicle 902 is at one end of a section of track 908, and vehicle 904 is at another end of the section of track 908. Vehicle 902 has a left beacon 902L and a right beacon 902R, which communicate with left beacon 904L and right beacon 904R of vehicle 904. In vehicle configuration 900, the beacons are all at a same beacon elevation h above track 908. In some embodiments, as described above, beacons on different vehicles have different beacon elevations above the track. In some embodiments, beacons on a same vehicle have different beacon elevations above the track. According to Method 1100 below, vehicle 902 is the vehicle of interest, and beacons 902L and 902R are configured to transmit a coded pulse to beacons 904L and 904R on vehicle 904 to determine position information of vehicle 904 in relation to vehicle 902. Beacons 904L and 904R are configured to, upon receiving a coded pulse from beacons 902L and 902R, each record the transmitted pulse and append the transmitted pulse to a reply pulse which is transmitted/returned to beacons 902L and 902R. For purposes of the present disclosure, beacons on a vehicle of interest are called transmitting beacons, and beacons on a different vehicle, or mounted at fixed locations with regard to the railway (e.g., track 908) are called reply beacons. In some embodiments, reply beacons on a vehicle other than the vehicle of interest also transmit coded pulse transmissions to other vehicles within line of sight, or beyond line of sight, of the vehicle where the beacons are mounted, and wait for reply pulses from other beacons, in order to determine inter-vehicle distances with vehicles or trains on the same track or other tracks. In vehicle configuration 900, the track 908 is straight and flat, such that the inter-vehicle distance C6 is the same as the measured distances R1 and R4 between beacons on the vehicles 902 and 904. Thus, vehicle 902, the vehicle of interest, uses mechanisms such as of tracking wheel motion to help track inter-vehicle distance C6 with a high degree of confidence because inter-vehicle distance C6 is the approximately the same is the length 921 of track 908 between vehicles. Inter-distance calculation based on two vehicles on a same track with constant grade (positive or negative grade) is similar to inter-distance calculation based on two vehicles on a same track with no grade (e.g., horizontal track).

Figure 10:
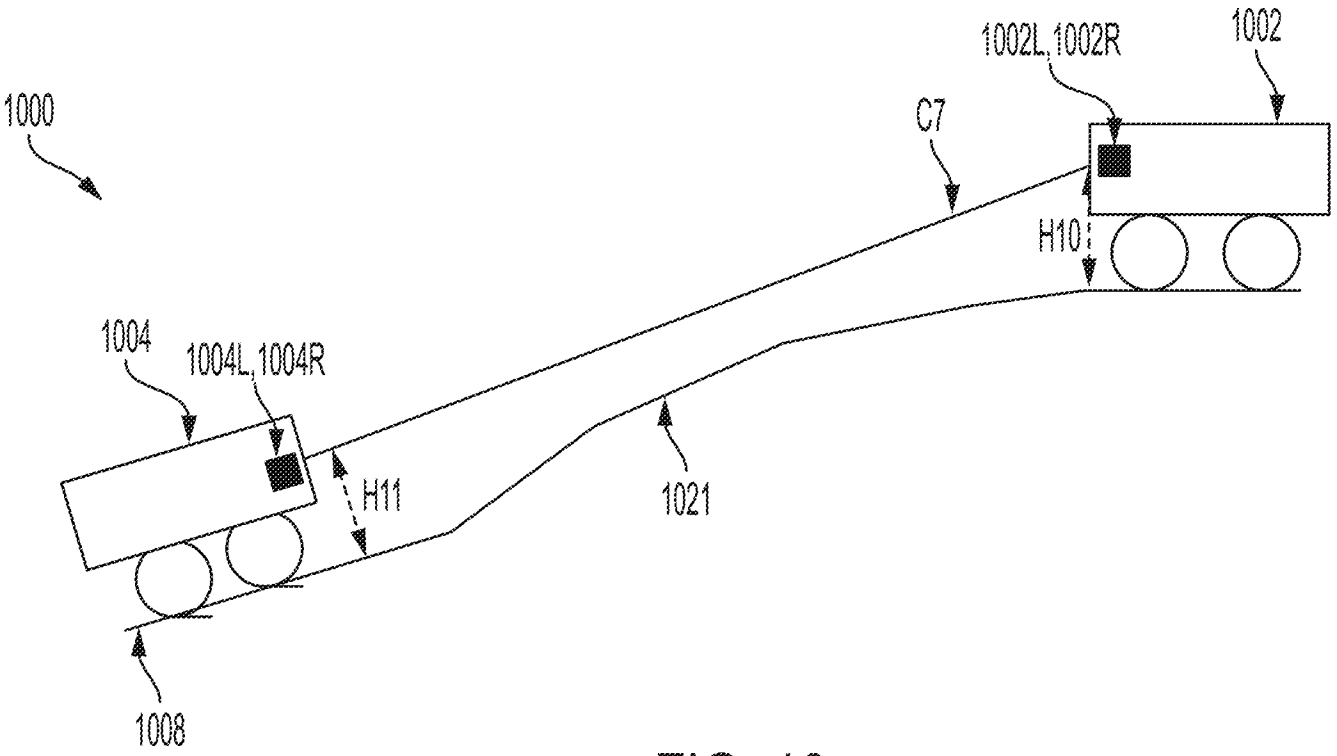
FIG. 10 is a diagram of vehicles during obstacle avoidance, in accordance with some embodiments.

FIG. 10 is a diagram of a vehicle configuration 1000 during obstacle avoidance, in accordance with some embodiments. In FIG. 10, elements which resemble, in structure of function, elements of FIG. 9 and vehicle configuration 900 have a same identifying numeral, incremented by 100. In vehicle configuration 1000, inter-vehicle distance C7 is less than a length of the tracks 1021 (or, the length of the railway) between vehicle 1002 and vehicle 1004. Beacon elevation H10 for left beacon 1002L and right beacon 1002R is different from beacon elevation H11 left beacon 1004L and right beacon 1004R on vehicle 1004. Inter-beacon distances R1 and R4 are equal to each other, and equal to inter-vehicle distance d, but the inter-beacon distances R1 and R4 are less than the length 1021 of the track 1008 between vehicle 1002 and vehicle 1004. Thus, the vehicle 1002 is not able to use mechanisms such as tracking wheel rotation, and so forth, to help track inter-vehicle distance C7 because the inter-vehicle distance is smaller than the (uneven) portion 1021 of track 1008 between the vehicles in vehicle configuration 1000. Grade changes along a section of track produce an under-estimate of the distance to be traveled by a vehicle along a track in order to collide with a second vehicle on the same track, regardless of whether the curvature is convex or concave.

Figure 11:
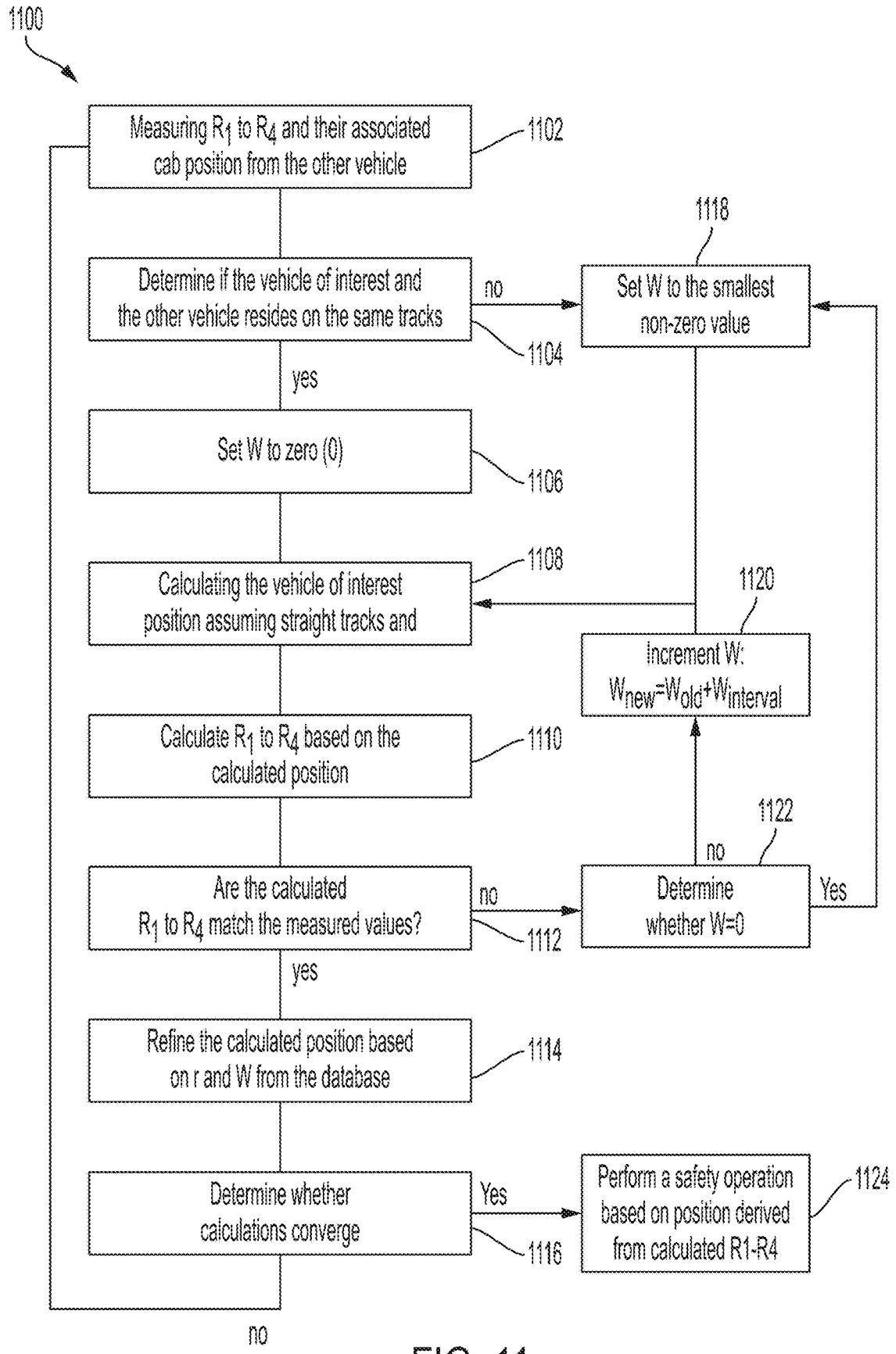
FIG. 11 is a flow diagram of a method of performing obstacle avoidance, in accordance with some embodiments.

FIG. 11 is a flow diagram of a method 1100 of performing safety operations for vehicles, in accordance with some embodiments. Method 1100 includes an operation 1102, in which the inter-beacon distances R1, R2, R3, and R4 are measured with respect to the vehicle of interest performing obstacle avoidance. In some embodiments, measuring inter-beacon distances R1–R4 includes an operation of transmitting a coded pulse from the transmitting beacons on a vehicle of interest to other beacons near the vehicle of interest (see, e.g., beacons 302R and 302L, and 304R and 304L in FIG. 3A). In some embodiments, the other beacons are mounted on other vehicles, coupled to the vehicle of interest. In some embodiments, the other beacons are mounted on other vehicles not coupled to the vehicle of interest. In some embodiments, the other beacons are mounted on fixed objects which are not connected to vehicles, such as poles, posts, or portions of the railway. In some embodiments, transmitting a coded pulse from the transmitting beacons includes an operation of encoding information into the coded pulse, which information provides the other beacons with information about the vehicle of interest, and which is used to determine inter-beacon distance and other vehicle operation information.

In some embodiments, the encoded information in the coded transmission includes beacon information such as: a train identification, a vehicle identification for the vehicle where the beacons are mounted, a vehicle end identification (e.g., is the beacon on an "A"-end or a "B"-end of the vehicle or train), the beacon location on the vehicle face/vehicle end (e.g., left or right side of the vehicle face), the inter-beacon separation distance w for the beacons on the face of the vehicle, beacon elevation information for each beacon on the face of the vehicle, a transmission time for the coded pulse, and an offset distance ε for the beacon centerline with respect to the centerline of the vehicle face.

Information about the train ID of the vehicle to which a beacon is mounted is transmitted from each beacon, along with additional information including train ID, vehicle ID, vehicle end ID (e.g., A-end, or B-end), beacon location on the vehicle (left side or right side beacon), the location of the end of a vehicle on the track (or, railway, or guideway, an absolute position measurement of the vehicle end), whether the end of the vehicle is a leading end or a trailing end of the vehicle, and so forth.

The method proposed in this disclosure to determine if the other vehicle is an obstacle to the vehicle of interest or not can be enhanced if the beacons installed on the other vehicle also reports if the cab they are installed on is the leading cab or the trailing cab. If the cab is the tailing cab it infers that under normal operation scenario the two vehicle are moving in the same direction with the vehicle of interest following the other vehicle. In this situation collision course is likely. However, if the cab is the leading cab it infers that under normal operation scenario the two vehicle are moving in opposite directions with the vehicle of interest "heading" towards the other vehicle. In this situation collision course is likely as this is not the normal operation scenario.

If 1 cm range measurement accuracy is anticipated based on inter-beacon distance measurements, the distance between the left beacon and the right beacon (beacon separation distance w), and the offset of the beacons centerline from the vehicle centerline (c) and beacon elevation above the track (h) should also have a position tolerance of ±1 cm. Measure inter-beacon distances with accuracy smaller than 1 cm involves tracking beacon placement to a smaller position tolerance (smaller than ±1 cm).

In some embodiments, measuring the inter-beacon distances R1–R4 includes an operation wherein the other beacons, whether on a vehicle coupled to the vehicle of interest, on a vehicle not coupled to the vehicle of interest, or not mounted to any vehicle, receive the coded pulse from the transmitting beacons, append the coded pulse to a coded reply pulse from each other/receiving beacon, and transmit a reply pulse which includes the coded pulse from the transmitting beacon, and beacon information from the replying beacon. For beacons mounted to vehicles, the beacon information included in the coded reply pulse includes information such as a train identification, a vehicle identification for the vehicle where the beacons are mounted, a vehicle end identification (e.g., is the beacon on an "A"-end or a "B"-end of the vehicle or train), the beacon location on the vehicle face/vehicle end (e.g., left or right side of the vehicle face), the inter-beacon separation distance w for the beacons on the face of the vehicle, beacon elevation information for each beacon on the face of the vehicle, a receipt time for the coded pulse from the transmitting beacon, a transmission time for the coded reply pulse, a and an offset distance ε for the beacon centerline with respect to the centerline of the vehicle face (e.g., information similar to the beacon information included in the coded pulse from the transmitting beacons). For beacons not mounted to a vehicle (e.g., beacons attached to stationary objects, signs, posts, or parts of the railway), beacon information includes at least a beacon identifier, a beacon location along the length of the track, a track identification for the beacon, a "side of the track" position of the beacon, a beacon elevation with respect to the track (e.g., a distance above the track, or below the track (for buried beacons)), a receipt time for the coded pulse from the transmitting beacon, a transmission time for the coded reply pulse, and so forth. In some embodiments, the coded reply pulse includes the time the transmitted coded pulse is received, in order to provide other beacons (e.g., transmitting beacons, with information about the time of flight of the coded pulse to the receiving beacon, and, by extension, the distance between the transmitting and receiving beacons). The other/replying beacon includes a transmission time of the reply beacon, in addition to the transmission time/receipt time of the coded pulse from the transmitting beacon, in order to provide further precision in determining inter-beacon and/or inter-vehicle distance by the transmitting beacon upon receiving the coded reply pulse. By comparing the inter-beacon transmission times, and multiplying the times by the speed of light (for electromagnetic transmission) the inter-beacon distances are calculated by an obstacle avoidance computer/vehicle control system. In some embodiments, the beacon which originates the coded pulse calculates the range to each responding replying beacon. The range measurement can be based on the measured TOF or any other range determination method.

The range measured by the beacons may be influenced by multipath propagation, total reflection, multiple propagation, etc. resulting in an incorrect range determined by the beacon. However, the method proposed in this disclosure is based on range measurement by two independent beacons (installed on the vehicle of interest) and another two independent beacons (installed on the other vehicle), therefore it is claimed here that the probability of all four (4) measurements being influenced in the same way by multipath propagation, total reflection and multiple propagation is improbable and can be mitigated by performing consistency checks based on the equations for vehicle configurations provided herein.

In some embodiments, a simplified consistency check is performed according to the equations below, where CT=a comparison threshold for the particular measurement being described:

$$CT1>|R1-R4| \quad \text{Equation (1),}$$

$$CT2>|R3-R2| \quad \text{Equation (2),}$$

$$CT3>|(R2-R1)|\approx|((R12+\omega^2)^{1/2}-R1| \quad \text{Equation (3)},$$

$$CT4>|(R4-R3)|\approx|((R42+\omega^2)^{1/2}-R4| \quad \text{Equation (4)},$$

$$CT5>|(R3-R1)|\approx|((R12+\omega^2)^{1/2}-R1| \quad \text{Equation (5)},$$

$$CT6>|(R4-R2)|\approx|((R42+\omega^2)^{1/2}-R4| \quad \text{Equation (6)}.$$

The consistency checks may indicate on a beacon failure, multipath propagation or any other failure conditions. Typical values for the comparison thresholds are from 5 cm to 20 cm, although other values for comparison thresholds may be used according to the particular configuration of rail vehicles and rail operation used on a railway. Risk of beacon failure or failing the comparison threshold is mitigated, in some embodiments, by complementing the beacon based system described herein with a radar system or LiDAR to directly measure the range to the other vehicle, the relative speed between the radar or LiDAR and the other vehicle, and the angular position (azimuth angle and elevation angle) of the other vehicle within the radar's or LiDAR's field-of-view to verify the consistency of the radar/LiDAR measurement with the inter-beacon distance measurements provided by the beacon system. Selecting different frequencies for radar and LiDAR, as compared to the beacon systems, reduces the risk of signal interference between the two systems, provide some additional redundancy or security in measuring inter-vehicle distance. For example, in some embodiments, a beacon base band frequency is 24 GHz and a radar or LiDAR base band frequency is 77 GHz, such that there is no direct overlap, and little risk of harmonic frequency interference, between the two systems. For further discussion, see the discussion of FIG. 13A and FIG. 13B, below. In some embodiments, the vehicle information such as such the train ID, vehicle ID, vehicle end ID, and location on the vehicle face (left/right) may be encoded within the radar and/or LiDAR signal in addition to encoding in the beacon signals.

Method 1100 includes an operation 1104, in which a determination is made as to whether the vehicle of interest is on a same track as other vehicles with beacons which reply to the transmitted coded pulse of operation 1102, or whether the other vehicle is on a different track than the vehicle of interest. As described above in relation to FIGS. 8A-8F, a determination that the vehicle of interest and the other vehicle are on the same track is made upon observing that R3−R2=0 and R3−R1=R2−R1, for vehicle arrangements and vehicle configurations, on tracks which are straight or curved. As described above in relation to FIGS. 8A-8F, a determination that the vehicle of interest and the other vehicle are not on the same track is made when: [1] R3−R2<R3−R1<R2−R1, such that R3−R2<0, R2−R1>0, and R3−R1>0, where, for both straight and curved tracks, the other vehicle is to the right of the track where the vehicle of interest is located; or [2] R2−R1<R3−R1<R3−R2, such that R3−R2>0, R2−R1<0 and R3−R1<0, where, for both straight and curved tracks, the other vehicle is on a track to the left of the track where the vehicle of interest is located. Determining a track location (e.g., same track, or different track) includes operations of performing one or more inter-beacon distance measurements to look for relative magnitudes, and changes in magnitude, of the inter-beacon distances over time.

In operation 1104, upon determining that the vehicle of interest and the other vehicle are not on the same track, the other vehicle is labeled as not being an obstacle and the method proceeds to operation 1118, wherein the inter-track distance is set to the smallest non-zero value provided in a range of inter-track distance values stored in a data storage of the vehicle obstacle avoidance system. According to some embodiments, inter-track distance values are stored in a data storage or computer-accessible memory which is part of the vehicle obstacle avoidance system, or a localization system on the vehicle. Upon completion of operation 1118, the method proceeds to operation 1108.

In operation 1104, upon determining that the vehicle of interest and the other vehicle are on the same track, the other vehicle is labeled as an obstacle (e.g., having collision potential) and the method continues to operation 1106.

In an operation 1106, based on determining that the other vehicle and the vehicle of interest are on the same track, the value of the inter-track distance W is set to 0 meters, and the method continues to operation 1108.

In operation 1108, the distance between the vehicle of interest and the other vehicle are calculated based on the assumption that the tracks are straight, and that the vehicles are on the same track. Calculations of the position of the other vehicle, with respect to the vehicle of interest, are performed using, e.g., time of flight measurements for signals transmitted between beacons and the best known position of the vehicle of interest at the time of calculation. In some embodiments, the calculations below are performed for each vehicle configuration (both straight and curved tracks). Inter-vehicle distances d are calculated by averaging the values of R1 and R4 (e.g., d=(R1+R4)/2). Calculating inter-vehicle distance by averaging R1 and R4 underestimates the distance between the vehicle of interest and the obstacle (the vehicle on the same track) if the horizontal curvature of the track is tight (e.g., the radius of curvature is small). However, because underestimating distance is beneficial for purposes of obstacle avoidance and braking, the approximation is useful in this situation.

In an operation 1110, the calculated inter-beacon distances R1−R4 are refined based on the calculated position of the vehicle of interest (e.g., by adding the calculated inter-vehicle distance d to the known position of the vehicle of interest).

The equations provided below indicate how to calculate inter-beacon distances R1−R4 for a set of vehicle configurations A-F, for straight tracks, and vehicle configurations G, H, J, K, L, and M for curved tracks.

The equations below describe how to calculate R1, R2, R3, and R4 as a function of d, W, ω and ε for straight tracks. In an embodiment where the two vehicles are on the same track, and have the same orientation (vehicle configuration "A"), $$R1=d \quad \text{Equation (A1)},$$

$$R2=(d^2+\omega^2)^{1/2} \quad \text{Equation (A2)},$$

$$R3=(d^2+\omega^2)^{1/2} \quad \text{Equation (A3)},$$

$$R4=d \quad \text{Equation (A4)}.$$

In an embodiment where the two vehicles are on the same track, but have opposite orientations, (vehicle configuration "B")

$$R1=(d^2+(2\varepsilon)^2)^{1/2} \quad \text{Equation (B1)},$$

$$R2=(d^2+(\omega+2\varepsilon)^2)^{1/2} \quad \text{Equation (B2)},$$

$$R3=(d^2+(\omega+2\varepsilon)^2)^{1/2} \quad \text{Equation (B3)},$$

$$R4=(d^2+(2\varepsilon)^2)^{1/2} \quad \text{Equation (B4)}.$$

In an embodiment where the vehicle of interest is on a first straight track, and the other vehicle is on a second track parallel to the first track, at the right side of the vehicle of interest, with the same orientation (vehicle configuration "C"), $$R1=(d^2+W^2)^{1/2} \quad \text{Equation (C1).}$$

$$R2=(d^2+(W+\omega)^2)^{1/2} \quad \text{Equation (C2),}$$

$$R3=(d^2+(W-\omega)^2)^{1/2} \quad \text{Equation (C3),}$$

$$R4=(d^2+W^2)^{1/2} \quad \text{Equation (C4).}$$

In an embodiment where the vehicle of interest is on a first straight track and the other vehicle is on a second track, parallel to the first track, at the right side of the vehicle of interest, with an opposite orientation (vehicle configuration "D"), $$R1=(d^2+(W+2\varepsilon)^2)^{1/2} \quad \text{Equation (D1),}$$

$$R2=(d^2+(W+\omega+2\varepsilon)^2)^{1/2} \quad \text{Equation (D2),}$$

$$R3=(d^2+(W-(\omega-2\varepsilon))^2)^{1/2} \quad \text{Equation (D3),}$$

$$R4=(d^2+(W+2\varepsilon)^2)^{1/2} \quad \text{Equation (D4).}$$

In an embodiment where the vehicle of interest is on a first straight track, and the other vehicle is on a second track parallel to the first track, at the left side of the vehicle of interest, with the same orientation (vehicle configuration "E"), $$R1=(d^2+W^2)^{1/2} \quad \text{Equation (E1).}$$

$$R2=(d^2+(W+\omega)^2)^{1/2} \quad \text{Equation (E2),}$$

$$R3=(d^2+(W+\omega)^2)^{1/2} \quad \text{Equation (E3),}$$

$$R4=(d^2+W^2)^{1/2} \quad \text{Equation (E4).}$$

In an embodiment where the vehicle of interest is on a first straight track and the other vehicle is on a second track, parallel to the first track, at the left side of the vehicle of interest, with an opposite orientation (vehicle configuration "F"), $$R1=(d^2+(W+2\varepsilon)^2)^{1/2} \quad \text{Equation (F1),}$$

$$R2=(d^2+(W-(\omega-2\varepsilon))^2)^{1/2} \quad \text{Equation (F2),}$$

$$R3=(d^2+(W+\omega+2\varepsilon)^2)^{1/2} \quad \text{Equation (F3),}$$

$$R4=(d^2+(W+2\varepsilon)^2)^{1/2} \quad \text{Equation (F4).}$$

FIG. 7, presented above, is a general case for the geometry of vehicles operating on curved tracks. The equations below describe how to calculate R1, R2, R3, and R4 as a function of $\phi$, r, W ($\Delta$r), $\omega$ and $\varepsilon$ for horizontal curved tracks.

In an embodiment where the two vehicles are on the same curved track, and have the same orientation (vehicle configuration "G"), $$R1=2\sin(\phi/2)r \quad \text{Equation (G1),}$$

$$R2=(\omega^2+4\sin^2[(\phi/2)r(r+\omega)])^{1/2} \quad \text{Equation (G2),}$$

$$R3=(\omega^2+4\sin^2[(\phi/2)r(r+\omega)])^{1/2} \quad \text{Equation (G3),}$$

$$R4=2\sin(\phi/2)r \quad \text{Equation (G4).}$$

In an embodiment where the two vehicles are on the same curved track, and have opposite orientations (vehicle configuration "H"):

$$R1=((2\varepsilon)^2+4\sin^2(\phi/2)r(r+2\varepsilon))^{1/2} \quad \text{Equation (H1),}$$

$$R2=((\omega+2\varepsilon)^2+4\sin^2(\phi/2)r(r+\omega+2\varepsilon))^{1/2} \quad \text{Equation (H2),}$$

$$R3=((\omega+2\varepsilon)^2+4\sin^2(\phi/2)r(r+\omega+2\varepsilon))^{1/2} \quad \text{Equation (H3),}$$

$$R4=((2\varepsilon)^2+4\sin^2(\phi/2)r(r+2\varepsilon))^{1/2} \quad \text{Equation (H4).}$$

Note that the identifying symbol "I" is not used for describing vehicle arrangements. Thus, there are no equations 1I, 2I, 3I, or 4I to describe vehicle arrangements. The next identifying symbol used is "J."

In an embodiment where the vehicle of interest is on a first curved track, and the other vehicle is on an adjacent curved track (a "parallel" track, one following a curve at a constant radius, different from the radius of the first curved track, from a center of curvature for the curved tracks) at the right side of the first curved track, and have the same orientation (vehicle configuration "J"):

$$R1=(W^2+4\sin^2(\phi/2)r(r+W))^{1/2} \quad \text{Equation (J1),}$$

$$R2=((W+\omega)^2+4\sin^2(\phi/2)r(r+W+\omega))^{1/2} \quad \text{Equation (J2),}$$

$$R3=((W-\omega)^2+4\sin^2(\phi/2)r(r-(W-\omega)))^{1/2} \quad \text{Equation (J3),}$$

$$R4=(W^2+4\sin^2(\phi/2)r(r+W))^{1/2} \quad \text{Equation (J4).}$$

In an embodiment where the vehicle of interest is on a first curved track, and the other vehicle is on an adjacent curved track (a "parallel" track, one following a curve at a constant radius, different from the radius of the first curved track, from a center of curvature for the curved tracks) at the right side of the first curved track, and have opposite orientations (vehicle arrangement "K"):

$$R1=((W+2\varepsilon)^2+4\sin^2(\phi/2)r(r+W+2\varepsilon))^{1/2} \quad \text{Equation (K1),}$$

$$R2=([W+\omega+2\varepsilon]^2+4\sin^2(\phi/2)r(r+W+\omega+2\varepsilon))^{1/2} \quad \text{Equation (K2),}$$

$$R3=([W-(\omega-2\varepsilon)]^2+4\sin^2(\phi/2)r(r-(W-(\omega-2\varepsilon)))^{1/2} \quad \text{Equation (K3),}$$

$$R4=((W+2\varepsilon)^2+4\sin^2(\phi/2)r(r+W+2\varepsilon))^{1/2} \quad \text{Equation (K4).}$$

In an embodiment where the vehicle of interest is on a first curved track, and the other vehicle is on an adjacent curved track (a "parallel" track, one following a curve at a constant radius, different from the radius of the first curved track, from a center of curvature for the curved tracks) at the left side of the first curved track, and have the same orientation (vehicle arrangement "L"):

$$R1=(W^2+4\sin^2(\phi/2)r(r-W))^{1/2} \quad \text{Equation (L1),}$$

$$R2=((W-\omega)^2+4\sin^2(\phi/2)r(r-(W-\omega)))^{1/2} \quad \text{Equation (L2),}$$

$$R3=((W+\omega)^2+4\sin^2(\phi/2)r(r+W+\omega))^{1/2} \quad \text{Equation (L3),}$$

$$R4=(W^2+4\sin^2(\phi/2)r(r-W))^{1/2} \quad \text{Equation (L4).}$$

In an embodiment where the vehicle of interest is on a first curved track, and the other vehicle is on an adjacent curved track (a "parallel" track, one following a curve at a constant radius, different from the radius of the first curved track, from a center of curvature for the curved tracks) at the right side of the first curved track, and have opposite orientations (vehicle arrangement "M"):

$$R1=((W-2\varepsilon)^2+4\sin^2(\phi/2)r(r-(W-2\varepsilon))^{1/2} \quad \text{Equation (M1),}$$

$$R2=((W-(\omega-2\varepsilon))^2+4\sin^2(\phi/2)r(r-(W-(\omega-2\varepsilon)))^{1/2} \quad \text{Equation (M2),}$$

$$R3=((W+\omega+2\varepsilon)^2+4\sin^2(\phi/2)r(r+W+\omega+2\varepsilon))^{1/2} \quad \text{Equation (M3)},$$

$$R4=((W-2\varepsilon)^2+4\sin^2(\phi/2)r(r-(W-2\varepsilon))^{1/2} \quad \text{Equation (M4)}.$$

For the curved track inter-beacon distance calculations provided above for vehicle arrangements G, H, J, K, L, and M, $\phi=d/r$ and $\sin(\phi/2)=d/(2r)$. For curved tracks, $\omega$ and $\varepsilon$ are constants for a specific rail system. The radii of curvature (r) and the lateral distance between parallel tracks (W or $\Delta r$) may vary as a function of the geographical location.

Based on the above equations for curved tracks, the equations for straight tracks are able to be approximated by treating the straight tracks as horizontal curved tracks with an infinite radius of curvature (e.g., $r=\infty$).

After performing a calculation of inter-beacon distances R1–R4 based on the estimated value of inter-vehicle distance from operation 1104, the method continues to operation 1112.

In operation 1112, a determination is made as to whether the calculated values of R1 and R4, from operation 1108, are a "match" for the inter-beacon distances measured in operation 1102. Matching of calculated and measured values of R1 and R4 is successful when the difference between the measured and calculated values for R1 and R4 are smaller than the following matching thresholds, for various values of inter-vehicle distance d, given below.

In the table, below, are reproduced representative values of matching thresholds ΔR (ΔR1 (e.g., |R1calculated–R1measured|), and/or ΔR4 (e.g., |R4calculated–R4measured|)) for various values of d, in meters (m), in addition to a calculated percentage of the distance represented by the matching threshold, for a horizontal radius of curvature of r=250 meters:

| d (m) | ΔR (cm) | % |
|---|---|---|
| 10 | 4.1 | 0.410% |
| 20 | 8.5 | 0.425% |
| 30 | 13.8 | 0.460% |
| 40 | 20.3 | 0.508% |
| 50 | 28.3 | 0.566% |
| 60 | 38.3 | 0.638% |
| 70 | 47.9 | 0.684% |
| 80 | 66 | 0.825% |
| 90 | 84.3 | 0.937% |
| 100 | 106.3 | 1.063% |

For distances larger than 100 meters, the systemic accuracy of range measurement (inter vehicle distance measurement) should be significantly more accurate than ±1 cm. In some embodiments, beacons are able to provide position measurement accuracy of about ±0.3 cm. In some embodiments, a more accurate estimation of the inter-vehicle distance d is obtained by estimating the horizontal radii of curvature for a portion of track using, e.g., a gyroscope or an array of gyroscopes) or by using an on-board database if the position of the vehicle of interest is known. The matching thresholds above are intended to be clarifying, but not limiting, as to the scope of the present disclosure. Other matching thresholds are also envisioned within the scope of the present disclosure to accommodate different rail operation scenarios, with different vehicle velocities along a portion of railway, with different vehicle widths, different inter-track distances, and different standards for radii of curvature of the tracks where rail operations occur.

Upon determining that the measured and calculated inter-beacon distances R1 and R4 fall within the matching thresholds for the vehicle, the method continues to operation 1114, wherein the estimated inter-vehicle distance is re-calculated to refine the estimate of the position of the other vehicle. Upon determining that the measured and calculated inter-beacon distances R1 and R4 do not fall within the matching thresholds for the vehicle, the method continues to operation 1122, wherein the inter-track distance used for calculating R1 and R4 according to the equations provided above, is evaluated for possible incrementing to a larger value. In operation 1122, a determination is made as to the magnitude of the inter-track distance W used for calculating R1 and R4. Upon a determination that W=0, the method 1100 continues to operation 1118, wherein W is set to a smallest non-zero value as provided by the vehicle obstacle avoidance system, and the method continues to operation 1108 to repeat calculation of the position of the vehicle of interest, as described above. Upon determination that W>0, the method 1100 continues to operation 1120, wherein W is incremented by one W-interval. Incrementing W by one W-interval means that the old value of inter-track distance for calculating R1 and R4 is incremented by adding a smallest non-zero inter-track distance interval to generate the new inter-track distance (e.g., Wnew=Wold+Winterval), where Winterrval is the smallest non-zero inter-track distance.

Method 1100 includes operation 1114, wherein the estimated inter-vehicle distance is re-calculated to refine the estimate of the position of the other vehicle. In operation 1114, the inter-track distance W for the present position of the vehicle of interest along the railway, and the radius of curvature r of the track at the present position of the vehicle of interest, are extracted form a database stored locally on the vehicle obstacle avoidance system, or retrieved from the traffic controller for the territory where the vehicle is located. Inter-vehicle distance is calculated for each of the vehicle configurations provided above in operation 1110, based on calculations of R1, R2, R3, and R4, and then averaging the newly calculated values of R1 and R4 for a new inter-vehicle distance estimate for each vehicle configuration described in operation 1110. Method 1100 continues in operation 1116.

In operation 1116, the inter-vehicle distance calculated in operation 1114 is compared to the inter-vehicle distance calculated in operation 1108, and a determination is made as to whether the inter-vehicle distance calculation from anyone of the vehicle configurations described in operation 1110 converges with the inter-vehicle distance calculated in operation 1114. Upon determining that there is no convergence, the method 1100 continues to operation 1102 to repeat measurement of R1 and R4 and seek a convergence of inter-vehicle distance. Upon determining that there is convergence, the method 1100 continues to operation 1124.

In an operation 1124, a safety operation is performed with regard to the other vehicle. In some embodiments, the safety operation includes localization of the other vehicle. In some embodiments, the safety operation includes modifying operation of the vehicle of interest (e.g., braking the vehicle of interest to avoid a collision with the other vehicle).

For collision avoidance, the most important attribute in the vehicle of interest position on the guideway is it will be located on the correct tracks. Position error on the correct tracks is acceptable (within limits) even if the position uncertainty is greater than the normal rail operation scenario because incorrect track assignment of a vehicle (e.g., placement of a vehicle on the wrong track) has a significantly higher likelihood of resulting in a collision than is associated with a mere positional error on a correct track. The typical vehicle separations for vehicles operation on a same track are usually significantly larger than the positional error described above.

Figure 12:
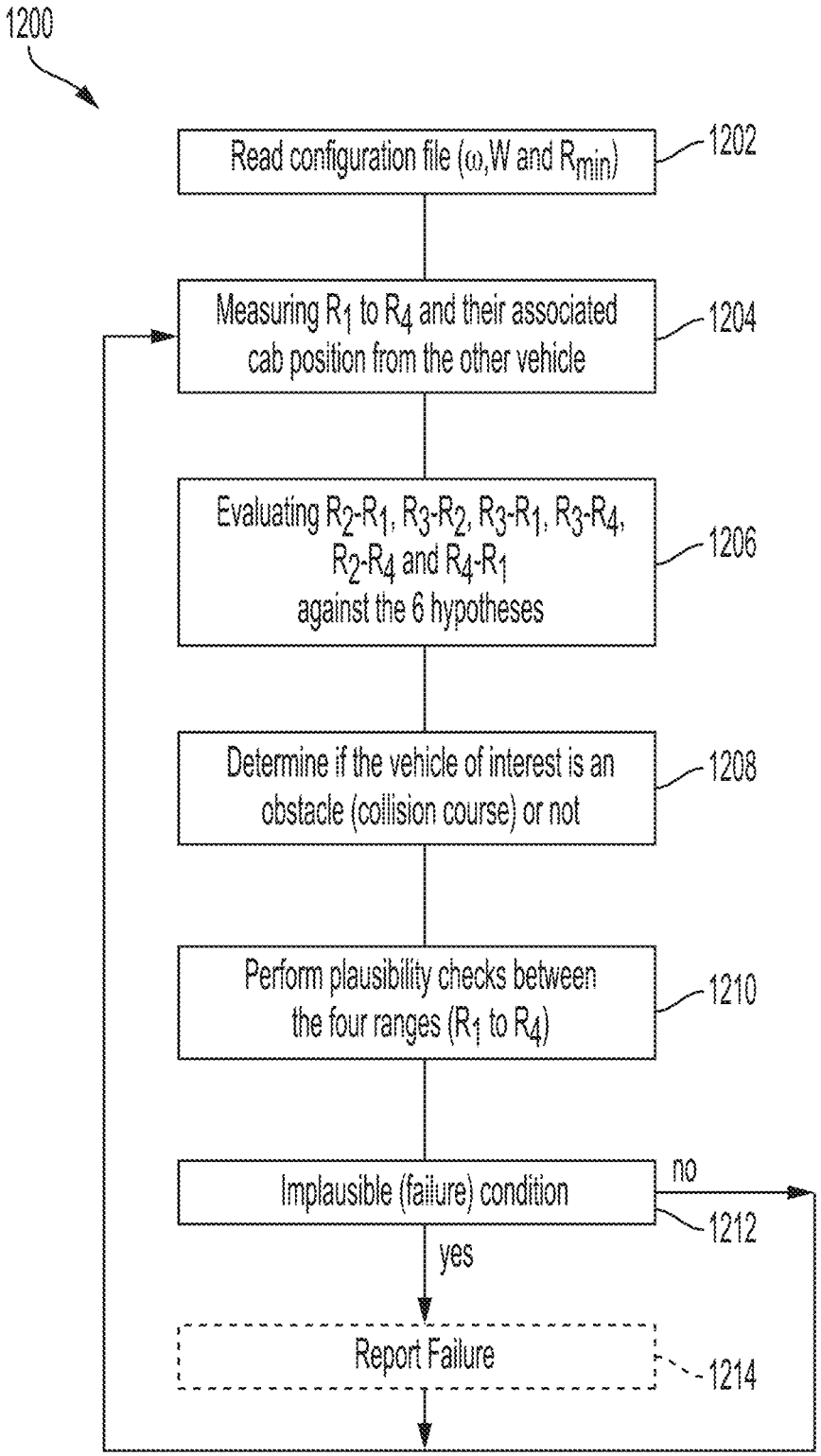
FIG. 12 is a flow diagram of a method of performing obstacle avoidance, in accordance with some embodiments.

FIG. 12 is a flow diagram of a method 1200 of determining whether a vehicle is an obstacle, in accordance with some embodiments. Method 1200 includes a first operation 1202, wherein an obstacle avoidance computer reads a configuration file having stored therein the beacon separation distances w for each pair of beacons on a vehicle, the track separation distance W for the current location of each vehicle of the train, and the Rmin of each vehicle in the train.

In an operation 1204, the inter-beacon distance is measured for each beacon on a vehicle, especially the leading end vehicle and the trailing end vehicles of a train, in order to determine separation distances between the leading and trailing vehicles of the train, and other vehicles on the track, or adjacent tracks, near the train.

In an operation 1206, the inter-beacon distance differences are compared against the predicted distances associated with the vehicle configurations described above for each of the straight track and curved track situations. More specifically, for each measured value of R1, R2, R3, and R4, the differences R2–R1, R3–R2, R3–R1, R3–R4, R2–R4, and R4–R1 are calculated and compared to computed values of the differences based on the values of beacon separation distances w, track separation distance W, and Rmin for each vehicle in the train. Upon each comparison, a determination is made as to whether the difference values converge (e.g., are consistent with a single vehicle configuration or track situation (curved or straight), or whether additional measurements and comparisons are to be performed to achieve convergence. Convergence is determined to occur when measured and calculated values for the differences R2–R1, R3–R2, R3–R1, R3–R4, R2–R4, and R4–R1 fall within convergence thresholds, as described above. Upon convergence, the method continues in operation 1208.

In operation 1208, the obstacle avoidance computer of the train (or, of a vehicle, such as the leading vehicle of the train) makes a determination as to whether another vehicle detected by the train obstacle avoidance computer is on a same track, and thus constitutes an obstacle or collision risk, or is on a different track, and thus does not constitute a collision risk.

In an operation 1210, subsequent to making the determination of operation 1208, the obstacle avoidance, or an associated computing system, performs a plausibility check to verify that the measurements R1, R2, R3, and R4 are accurate, and do not have erroneously large or small values which would result in an incorrect determination in operation 1208. Upon determining that a plausibility check failure has occurred, the method continues to operation 1210. Upon determining that no plausibility check failure has occurred, the method continues to operation 1204.

Upon completion of the plausibility check of operation 1210, the method continues to operation 1212, wherein any plausibility check failure is reported. Optional operation 1214 involves reporting the failed plausibility check to the obstacle avoidance computer. In some embodiments, the failed plausibility check is reported to a human operator. In some embodiments, the failed plausibility check is reported to a traffic controller, or other position monitoring system.

Figure 13A:
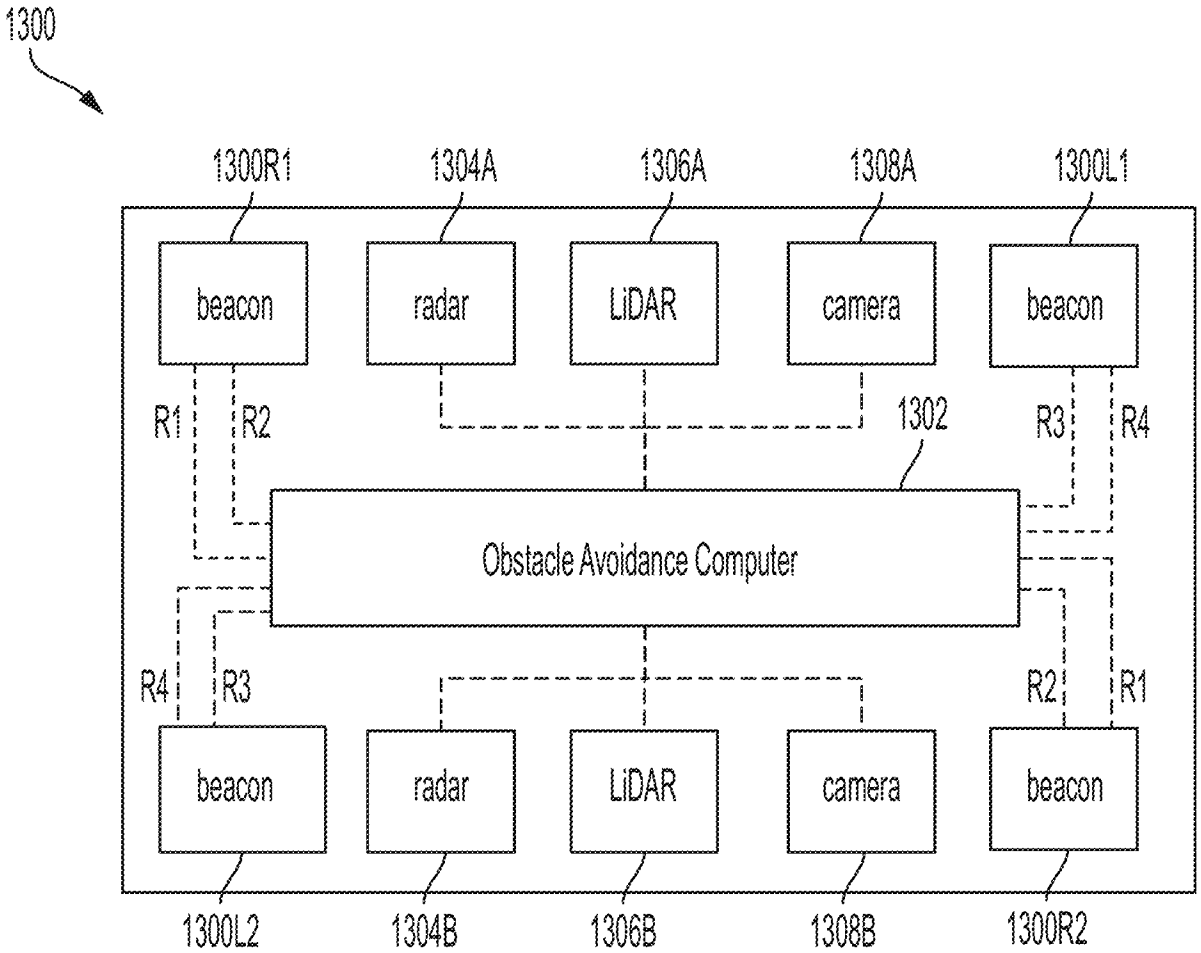
FIGS. 13A-13B are schematic diagrams of obstacle avoidance systems, in accordance with some embodiments.

FIG. 13A is a schematic diagram of a vehicle 1300 with obstacle avoidance system, in accordance with some embodiments. Vehicle 1300 includes an obstacle avoidance computer 1302, electrically connected to a plurality of beacons, cameras, radar systems, and LiDAR systems. Other obstacle avoidance equipment, including communication equipment, range finding equipment, and position detecting equipment (including global positioning satellite systems) are also within the scope of the present disclosure, although not expressly drawn in vehicle 1300.

Beacons 1300R1 and 1300L1 are at one end of the vehicle, and beacons 1300R2 and 1300L2 are at the other end of the vehicle. Beacons 1300R1 and 1300R2 report inter-beacon distances R1 and R2 to the obstacle avoidance computer 1302. Beacons 1300L1 and 1300L2 report inter-beacon distances R3 and R4 to the obstacle avoidance computer. The distances R1, R2, R3, and R4 are used, herein, as representative of the beacon-to-beacon communication pattern described hereinabove to determine inter-vehicle distance, and find a converging solution for obstacle identification and avoidance based on the vehicle configurations described above. Radars 1304A and 1304B provide additional range finding capabilities, as do LiDAR units 1306A and 1306B, at each end of vehicle 1300. Cameras 1308A and 1308B provide additional proximity warning, train identification, and position determination functions for the vehicle 1300, in some embodiments.

The obstacle avoidance computer 1302 receives and processes information from each of the beacon, radars, LiDARs, and cameras, and performs beacon-to-beacon distance comparisons between measured and calculated inter-beacon distances to identify trail collision conditions and trigger safety operations to avoid collisions. In some embodiments, safety operations include applying a brake to stop the vehicle before a collision. In some embodiments, safety operations include transmitting, to a broken vehicle, a position of the lead or trailing car of the broken vehicle in order to initiate localization of the broke vehicle. In some embodiments, the safety operation includes monitoring coupling status and calculating train length of the train having the vehicle therein, to receive movement authority. In some embodiments, monitoring coupling status and calculating train length are also associated with verifying that switching at a yard or station has been successfully completed.

Localization of a broken vehicle involves a guidance system, localization computer, or an obstacle avoidance computer on the broken vehicle recognizing at least one of (1) a communication breakdown between the broken vehicle and the traffic controller for the territory in which the broken vehicle is located, and (2) a loss of location information by the broken vehicle, either for the broken vehicle itself, or for vehicles known by the broken vehicle to have been nearby at or before a communication loss between the broken vehicle and the traffic controller for the territory. Upon determining that a broken vehicle has lost communication or location information, the broken vehicle (or, a computer system thereon, including, in some embodiments, an obstacle avoidance computer as described herein), sets a condition flag that triggers recording of position information from beacons located near or below the tracks on which the broken vehicle, or near the tracks where the broken vehicle, or beacons on other vehicles moving near the broken vehicle. Upon determining that other beacons, whether on or near the tracks, or on other vehicles, contain location information for the other beacons, the broken vehicle records the position information (which information is, in some embodiments, recorded by the broken vehicle obstacle avoidance computer, and added to a coded reply pulse from the beacons on the broken vehicle to the other vehicle) and retain the location information for comparison to subsequent coded pulses from the other vehicle beacons. In some embodiments, the time of flight of the first coded pulse with location information includes a timestamp for the transmission time of the first coded pulse, which timestamp is compared to the timestamp for the broken vehicle beacons' receipt of the first coded pulse. In some embodiments, the location information of the first coded pulse, the timestamp of the first coded pulse, and the timestamp for receipt of the first coded pulse by the broken vehicle are used to determine an approximate position of the broken vehicle, which approximate position is refined using subsequent coded pulses from the transmitting vehicle (e.g., the vehicle which send the first coded pulse), or a different transmitting vehicle. The broken vehicle, upon receiving additional information from nearby vehicles, uses the approximate position (subject to subsequent refinement by the additional, subsequent coded pulses), as a basis for initiating motion along a track pending reestablishing communication with a traffic controller for the territory, or pending approaching a set of beacons on or near the track (trackside beacons) having known, fixed, absolute positions along the track, to establish an more precise vehicle position during motion along the track. Thus, motion of a vehicle during unattended train operation (UTO) after loss of communication or position information, is the result of inter-vehicle communication based on the location information and coded pulse transmission timestamp being received by a broken vehicle.

Figure 13B:
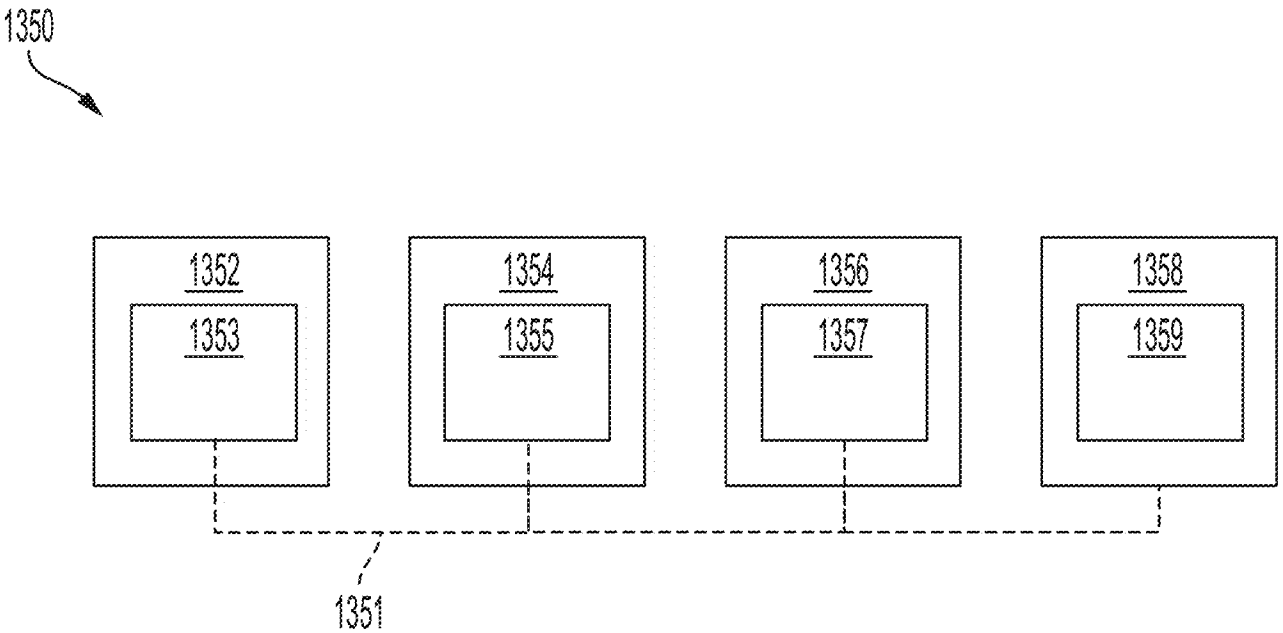

FIG. 13B is a schematic diagram of a train 1350 with an obstacle avoidance system similar to obstacle avoidance computer 1302, in accordance with some embodiments. In train 1350, each vehicle 1352, 1354, 1356, and 1358, has an associated obstacle avoidance computer 1353, 1355, 1357, and 1359 mounted therein. Each obstacle avoidance computer is configured to transmit, from the beacons on the base vehicle where the obstacle avoidance computer is mounted, inter-beacon distance measurements for monitoring train position, obstacle avoidance, and train length/train coupling status. Obstacle avoidance computers communicate by a communication network 1351. In some embodiments, communication network 1351 is a wired network between vehicles. In some embodiments, communication network 1351 is a wireless network between vehicles. In some embodiments, communication network 1351 include both wired and wireless components to provide redundant communication between obstacle avoidance computers and avoid error conditions during rail operations.

When performing localization or position verification using trackside beacons, the right beacon in each beacons array arrangement report R1 and R2 to the obstacle avoidance computer together with the trackside beacon ID the measurement was taken against. Similarly, the left beacon in each beacons array arrangement report R3 and R4 to the obstacle avoidance computer together with the trackside beacon ID the measurement was taken against.

Figure 14:
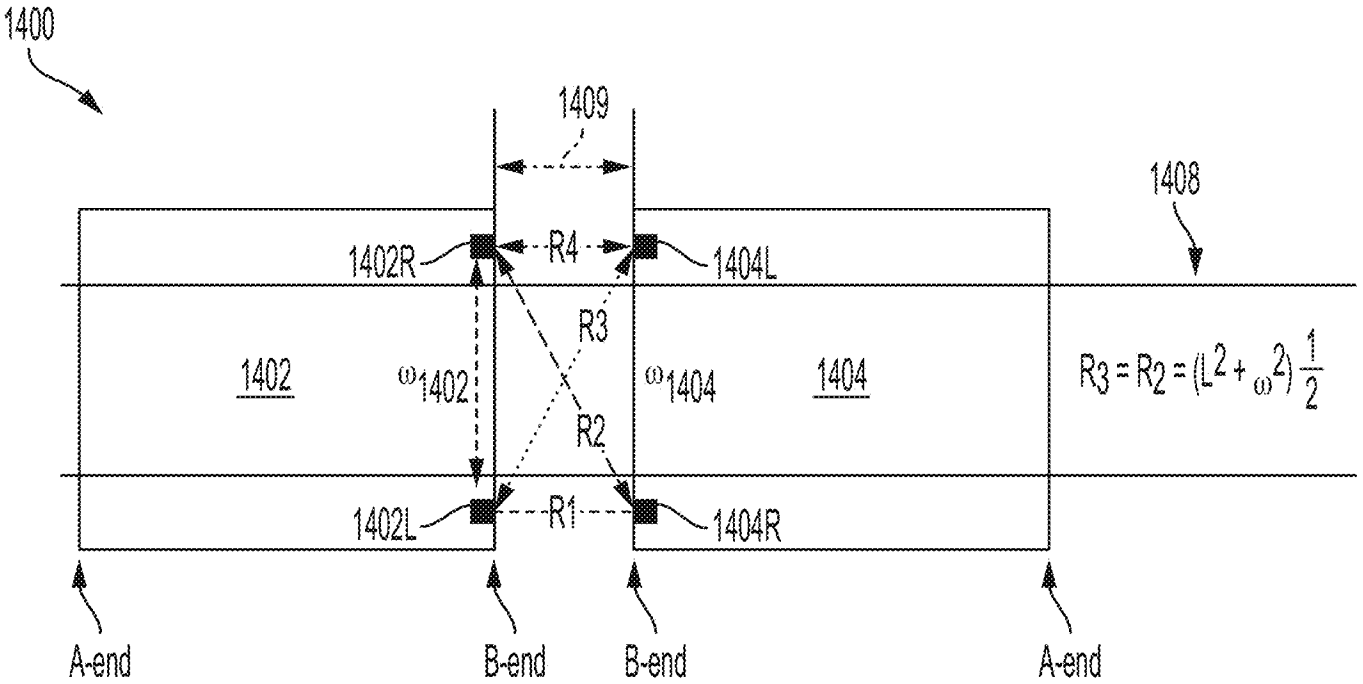
FIG. 14 is a top view of a vehicle configuration during a coupling determination, in accordance with some embodiments.

FIG. 14 is a top view of a vehicle configuration 1400 during coupling determination, in accordance with some embodiments. Vehicle 1402 and vehicle 1404 are on track 1408 during coupling. Inter-vehicle distance 1409 is the coupling distance L, the distance between cars after successful coupling. Beacons 1402L and 1402R, and 1404L and 1404R, transmit coded pulses between vehicles to determine the inter-vehicle distances R1, R2, R3, and R4 for the vehicle configuration 1400. For a known beacon separation distance ω1402 for vehicle 1402, and known beacon separation distance ω1404 for vehicle 1404, and assuming that ω1402=ω1402, successful coupling is determined to have occurred when, for each vehicle, the inter-beacon distances R2 and R3 are equal (within tolerances) and R1=R4=coupling distance L (inter-vehicle distance 1409). According to some embodiments, coupling distance L is between about 40 cm and about 70 cm, although other coupling distances are consistent with the present disclosure.

In some embodiments, R2 and R3 are equal (or, within a certain tolerance) too and their value must be (L2+ω2)½ (within a tolerance). The tolerance between R1 and R4 is expected to be ±5 cm and the tolerance between R2 and R3 is expected to be ±5 cm.

Figure 15:
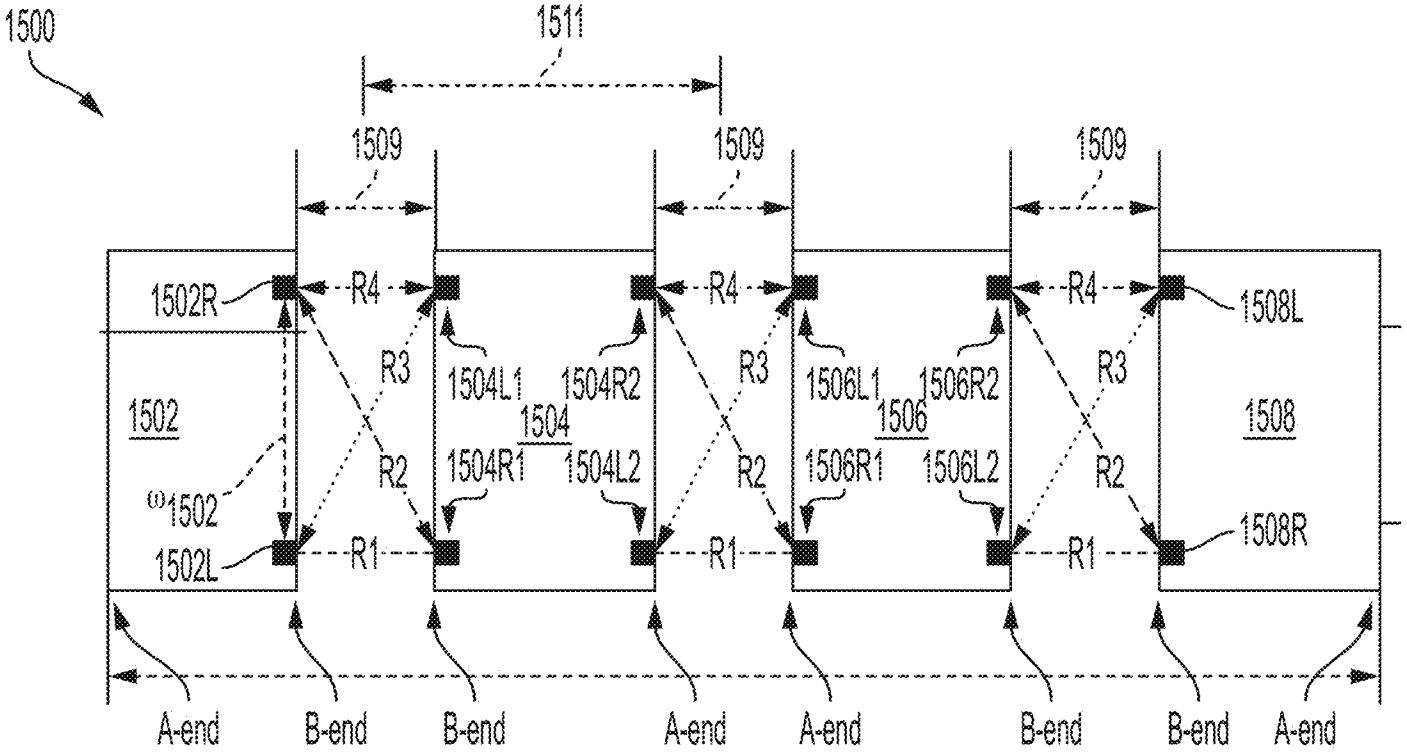
FIG. 15 is a top view of a vehicle configuration during a coupling determination, in accordance with some embodiments.

FIG. 15 is a top view of a vehicle configuration 1500 during coupling determination and train length determination, in accordance with some embodiments. When a coupling state between two vehicles is confirmed according to the method explained above, then at a higher level (e.g. the on-board computer managing the train) the train length is determined based on the following rules: first, the coupled vehicles are configured to communicate a pattern of connection, and a vehicle order between coupled vehicles; second, end vehicles are vehicles with only 1 end coupled to another vehicle; and not more than two (2) vehicles of a train are end vehicles (coupled to only other vehicle, or only at one end) on a single train.

Vehicle configuration 1500 is a train having 4 vehicles therein: vehicle 1502, vehicle 1504, vehicle 1506, and vehicle 1508. Vehicle 1502 has left beacon 1502L and right beacon 1502R. Vehicle 1504 has left beacon 1504L1 and right beacon 1504R1 toward vehicle 1502, and left beacon 1504L2 and 1504R2 toward vehicle 1506. Vehicle 1506 has left beacons 1506L1 and 1506L2, and right beacons 1506R1 and 1506R2, as shown. Vehicle 1508 has left beacon 1508L and right beacon 1508R. For each vehicle, the beacon separation distance ω (ω1502) is the same, for simplicity of presenting the trail length calculation method. As described above, the methods herein do not require each vehicle to have a same beacon separation distance ω. The coupling distance L (distance 1509) is treated as being the same for each vehicle, and the vehicle length 1511, for "middle cars" includes the length of the vehicle itself, and the coupling distance L (distance 1509), half on each end of the vehicle body.

Thus, train length is determined as follows:

$$LT=(n\text{Coupled}+2)\times LV \qquad \text{Equation (7)},$$

where LT=the train length, nCoupled is the number of vehicles coupled at two ends, and LV is the length of each vehicle.

Figure 16A:
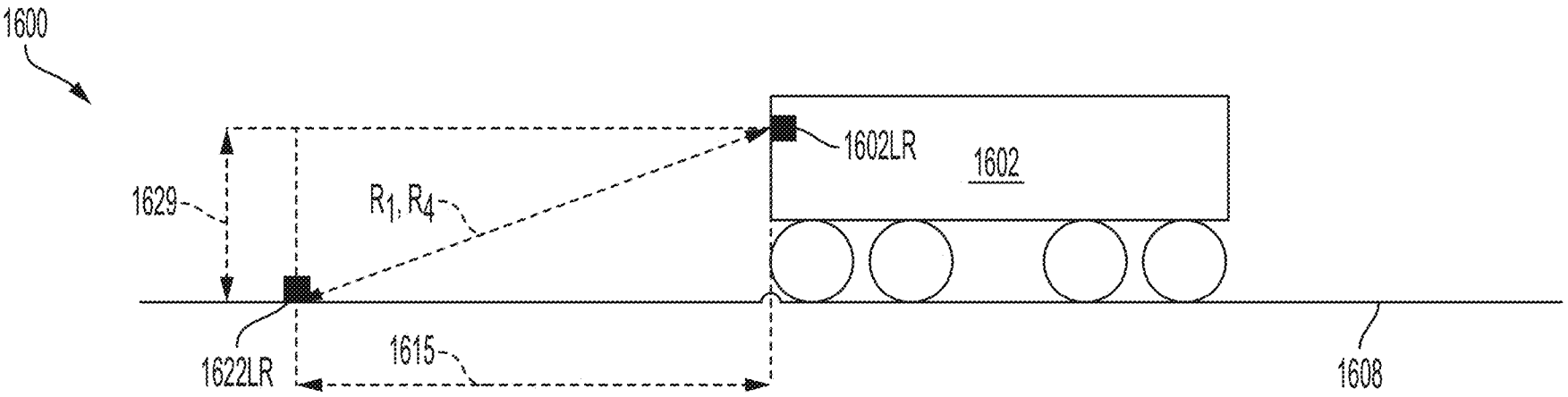
FIGS. 16A-16B are views of vehicles during vehicle localization, in accordance with some embodiments.
Figure 16B:
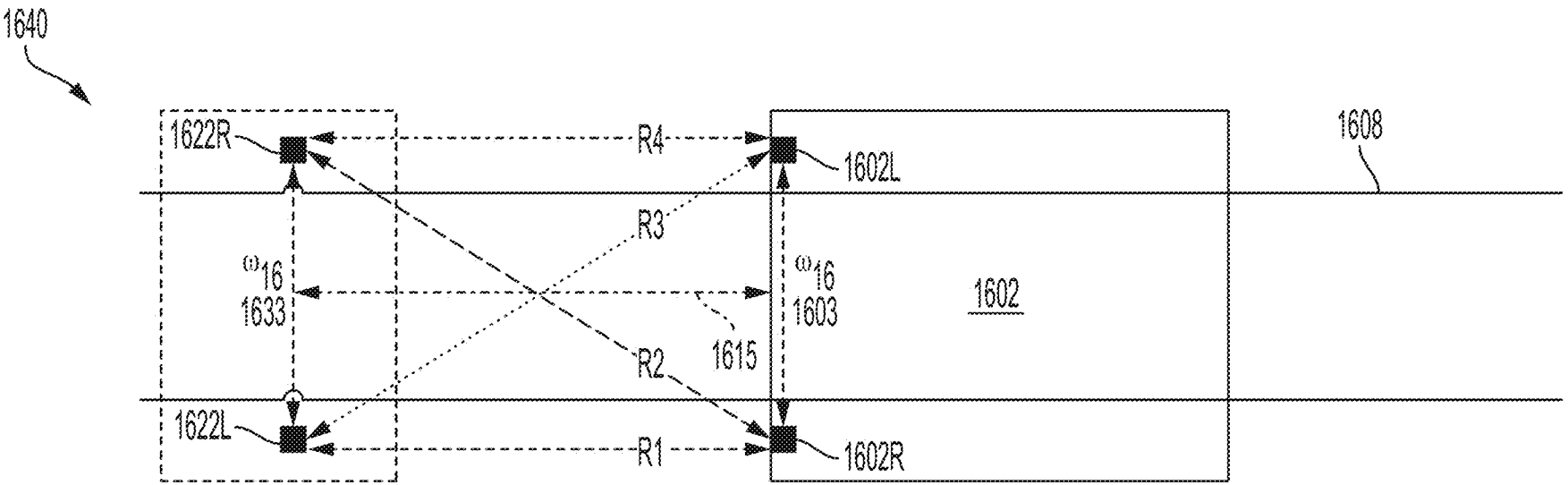

FIGS. 16A-16B are views of vehicles during vehicle localization, in accordance with some embodiments. FIG. 16A is a side view of vehicle configuration 1600, wherein vehicle 1602 is on track 1608 and approaching beacons 1622L and 1622R, which are trackside beacons, embedded in, or on, or near, the track 1608. Distance 1615 is the lateral distance between the front face of the vehicle 1602 (or, the beacons 1602L and 1602R) and the beacons 1622L and 1622R. Vehicle localization method using a pair of beacons installed on the same tracks the vehicle is moving on. When trackside beacons have an identical, or similar arrangement, as the beacons of the vehicle being localized (see FIGS. 16 and 17), R1 and R4 are nearly equal (within tolerances) and R2 and R3 are nearly equal (within tolerances). Thus, the expected values of R2 and R3 are:

$$R2=R3=(R1^2+\omega^2)^{1/2}=(R4^2+\omega^2)^{1/2} \qquad \text{Equation (8)},$$

and location of the vehicle on the guideway is determined by $$\text{VehiclePosition}=\text{BeaconPosition}-(R_{14}^2-h^2)^{1/2} \qquad \text{Equation (9)},$$

where VehiclePosition is the absolute position of the vehicle on the railway track, BeaconPosition is the position of the beacon along the railway track, $R_{14}$ is the average of distances R1 and R4, and h is the beacon elevation for beacons 1602L and 1602R.

FIG. 16B is a top view of vehicle configuration 1640 during vehicle localization, in accordance with some embodiments. Elements of vehicle configuration which match, in description or function, the elements of vehicle configuration 1600, have a same identifying numeral. Differences between vehicle configuration 1600 and vehicle configuration 1640 are presented below. Vehicle configuration 1640 shows that the beacon separation distance ω16 for beacons 1622R and 1622L (beacon separation distance 1633), is the same as the beacon separation distance between beacons 1602L and 1602R (e.g., beacon separation distance 1603=ω16).

Figure 17A:
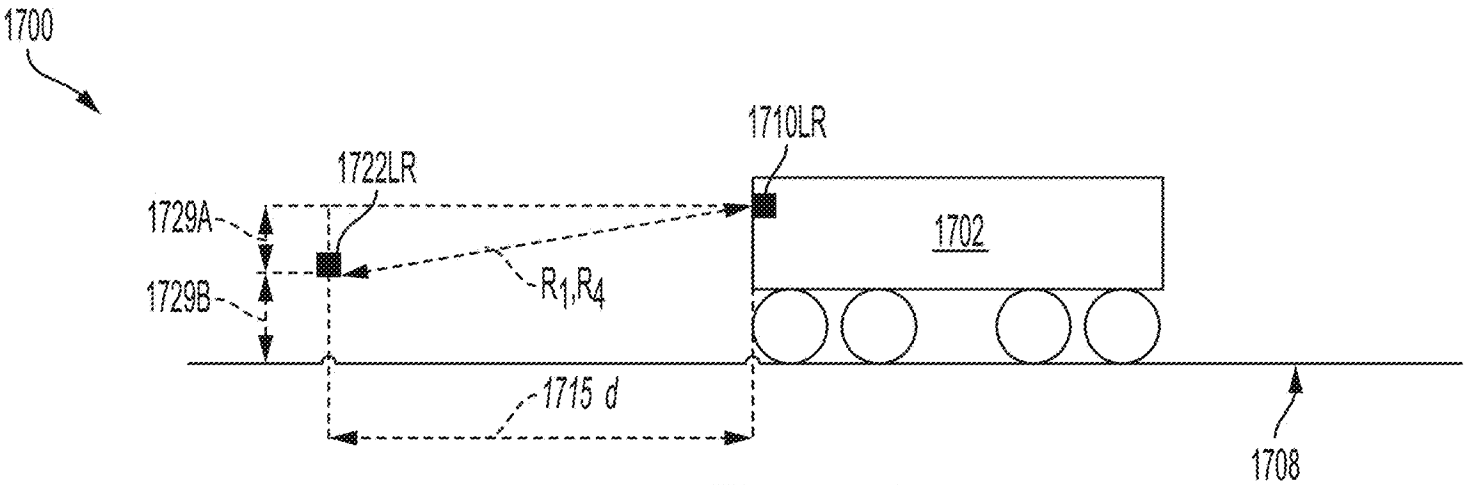
FIGS. 17A-17B are views of vehicles during vehicle localization, in accordance with some embodiments.
Figure 17B:
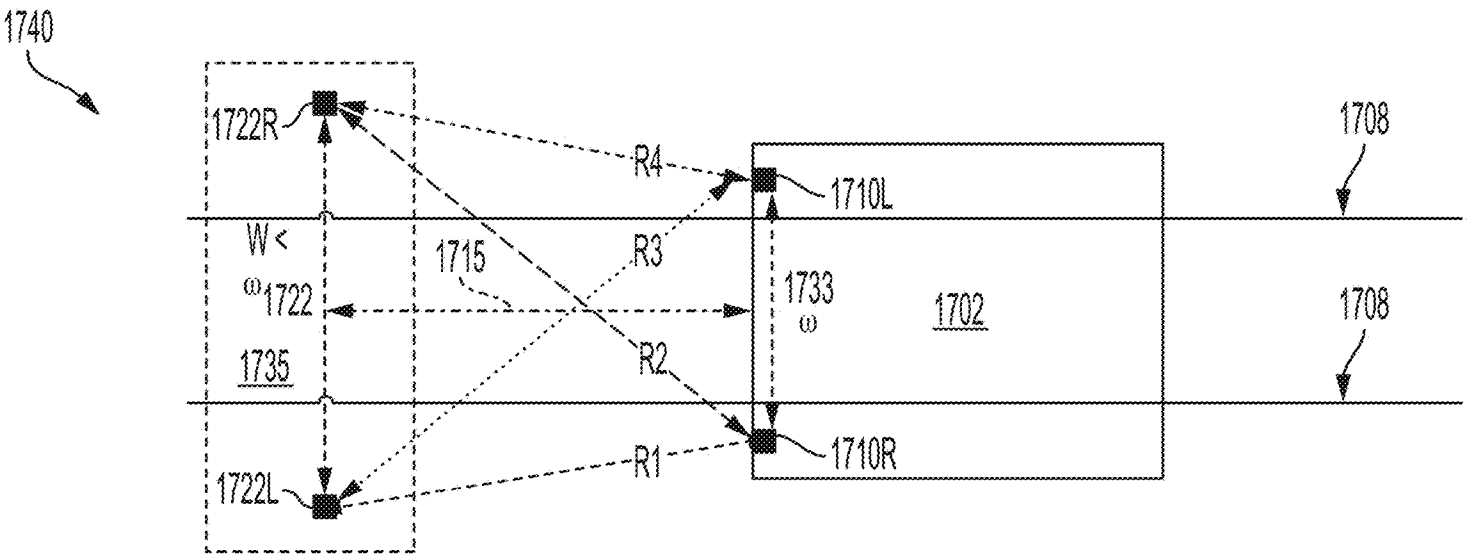

FIGS. 17A-17B are views of vehicles during vehicle localization, in accordance with some embodiments. FIG. 17 is a side view of a vehicle configuration 1700 during vehicle localization, in accordance with some embodiments. In vehicle configuration 1700, vehicle 1702 is located on a track 1708 and has a pair of vehicle beacons 1702L and 1702R. Vehicle beacons 1702L and 1702R are at a height h above the track 1708. Beacons 1722L and 1722R are track-side beacons, mounted at a first distance 1729B (an elevation, sometimes called hB) above the top of the track 1708, and a second distance 1729A (a depression, sometimes called the height h (e.g., the height difference between the vehicle beacon and the topmost track-side beacon). Vehicle 1702 is a separation distance 1715 away from the beacon locations on the railway.

$$R2=R3=(R_{14}^2+\omega\omega_1)^{1/2}=(R42+\omega\omega_1)^{1/2} \quad \text{Equation (10),}$$

where R1/4 (or $R_{14}$) is the average value of the R1 and R4 measurements [$R_{14}$=(R1+R4)/2], and the values of R1, R2, R3, and R4 are within measurement tolerances. In some embodiments, measurement tolerance are within about ±5 cm, although other tolerances are anticipated in accordance with hardware characteristics of beacons and other range-finding equipment installed on vehicles.

The vehicle position is sometimes determined by combining the known beacon position with the measured beacon distances as follows:

$$VP=BP-(R_{14}^2-h^2-(0.5(\omega_1-\omega))^2)^{1/2} \quad \text{Equation (11),}$$

where VP is the vehicle position after localization, or the position of the face of the vehicle where the beacons are installed on the vehicle end A or end B, with respect to the guideway, BP is the beacon position of the trackside beacons (beacons 1722L and 1722R); $R_{14}$ is the average value of the R1 and R4 measurements [e.g., $R_{14}$=(R1+R4)/2], ω is the beacon separation distance for beacons on the vehicle, $\omega_1$ is the beacon separation distance for the trackside beacons, and h is the h is the height of the vehicle's beacons above the trackside beacons. In FIG. 17A and FIG. 17B, the beacons are not below the trackway, but are mounted above the trackway. Thus, the height difference which is relevant to determining the vehicle position is the second distance 1729A, between the trackside beacons (1722L and 1722R) and the vehicle beacons (1702L and 1702R). First distance 1729B, of the beacons over the top surface of track 1708, does not figure in the position calculation.

Here, the separation distance 1715 (d) of vehicle 1702 from the trackside beacons 1722L and 1722R and the inter-beacon distances R1 and R4 (collectively, R) treated as being significantly less than the radii of curvature of the tracks. For example, in an embodiment where minimum radius of curvature of the track 1708 is 250 meters, d and R are expected to be less than 50 meters, otherwise the influence of track curvature becomes significant. Typical h for this type of application is between approximately 1 meters and approximately 4 meters. Higher accuracy measurements of R are anticipated to be significantly greater than h, e.g., R>3 h or errors in the beacon elevation as associated with vehicle motion impact the accuracy of vehicle localization. In some embodiments, the present method is suitable for localization at inter-vehicle distances, or inter-beacon distances between about 15 meters and about 50 meters. At distances outside of this range, localization accuracy drops off because of errors in determining beacon height.

Figure 18A:
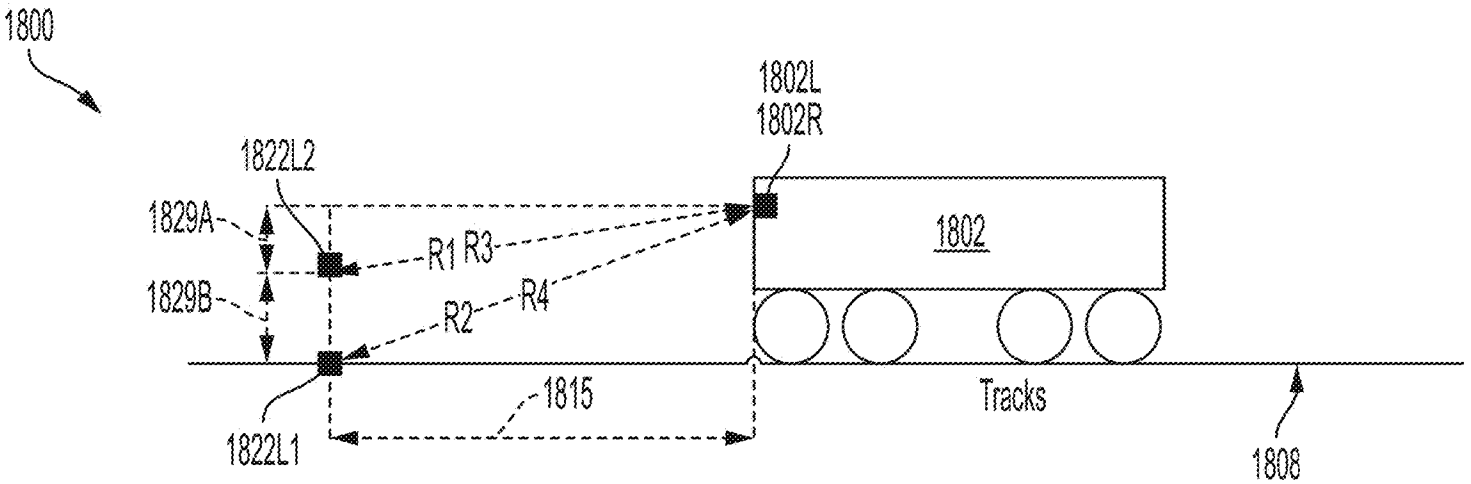
FIGS. 18A-18B are views of vehicles during vehicle localization, in accordance with some embodiments.
Figure 18B:
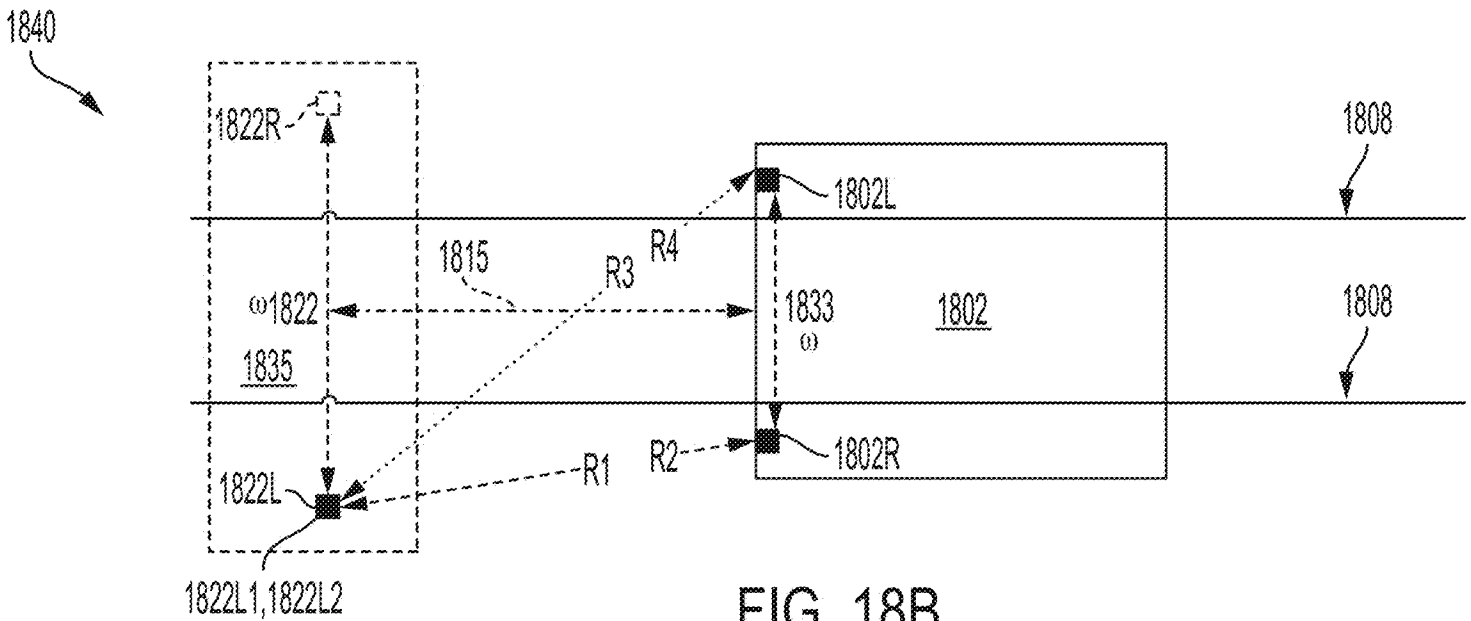

FIGS. 18A-18B are views of vehicles during vehicle localization, in accordance with some embodiments. FIG. 18A is a side view of a vehicle configuration 1800, wherein a vehicle 1802 is on a track and has beacons 1802L and 1802R. Beacons 1802L and 1802R are at a separation distance 1815 d from the beacons 1822L1 and 1822L1 at the left side of the track 1808 (as viewed from vehicle 1802). FIG. 18B is a top view of a vehicle configuration 1840, in accordance with some embodiments. In FIG. 1840, elements which have a similar function and description to elements of FIG. 1800 have a same identifying numeral. Beacons 1822L1 and 1822L2 are at different heights (1822L1 at hB (height 1829B), and 1822L2 at height h+hB (height 1829B+1829A) with respect to the beacons 1802L and 1802R on vehicle 1802. Further, the expected beacon separation distance for trackside beacons on the track is large with respect to the track width W (e.g., W<ω1822) or the beacon separation distance ω for beacons 1802L and 1802R on the vehicle. The location of vehicle 1802 on the track 1808 is determined below. Vehicle localization in this case has R1≠R4 and R2≠R3. Thus, R2 & R3 determined by:

$$R2=(R1^2+hB^2+2hhB)^{1/2} \quad \text{Equation (12),}$$

and $$R3=(R1^2-hB^2-2hhB)^{1/2} \quad \text{Equation (13).}$$

Vehicle position (VP) is determined by the equations below:

$$VP=BP-(R1^2-h^2-(0.5(\omega_1-\omega))^2)^{1/2} \quad \text{Equation (14),}$$

and $$VP=BP-(R4^2-(h+hB)^2-(0.5(\omega_1+\omega))^2)^{1/2} \quad \text{Equation (15),}$$

where VP is the vehicle position, BP is the beacon position along the guideway, R1 is an inter-beacon distance, R4 is an inter-beacon distance, h is the height of the top-most beacon (trackside beacon) below the vehicle beacons, hB is the height of the lower track beacon above the top of the tracks, ω, is the width between the vehicle beacons, and $\omega_1$ is the anticipated beacon separation distance based on the position of beacons 1822L1 and 1822L2.

Figure 19A:
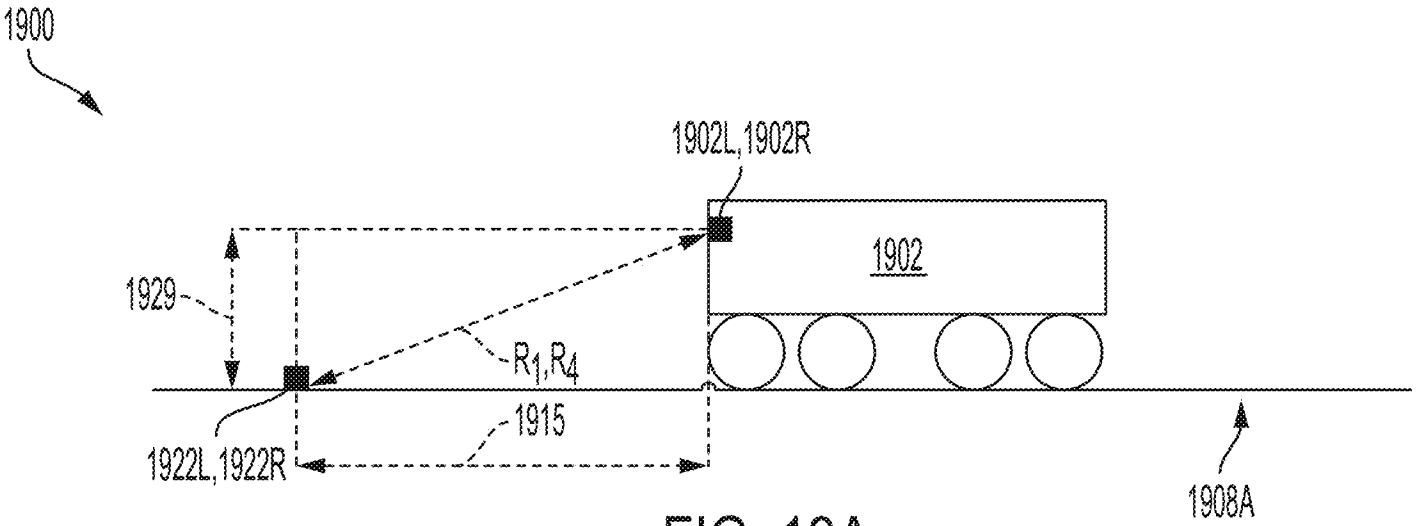
FIGS. 19A-19B are views of a vehicle during vehicle localization, in accordance with some embodiments.
Figure 19B:
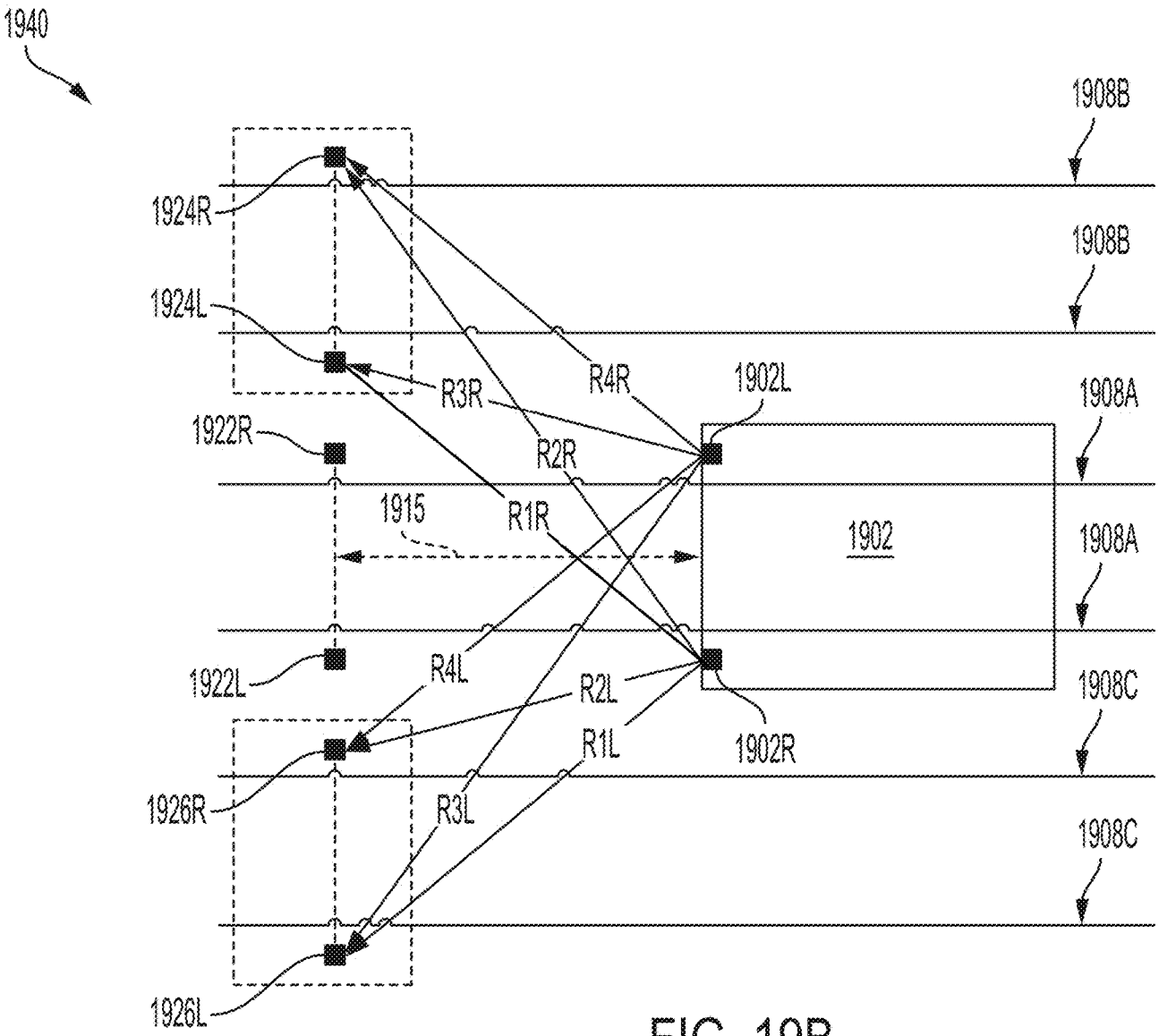

FIGS. 19A-19B are views of a vehicle during vehicle localization, in accordance with some embodiments. FIG. 19A is a top view of a vehicle configuration 1900 during vehicle localization, in accordance with some embodiments. In vehicle configuration 1900, wherein a vehicle 1902 is on a track 1902A, and beacons 1902L and 1902R are mounted on a face of the vehicle toward trackside beacons 1922L and 1922R. Separation distance 1925 is between the beacons 1902L and 1902R, and the beacons 1922L and 1922R. Beacons 1920L and 1902R are at a beacon elevation 1929 above the trackside beacons 1922L and 1922R.

FIG. 19B is a side view of a vehicle configuration 1940, during vehicle localization, in accordance with some embodiments. In vehicle configuration 1940, elements which have a same function and description as in FIG. 1900 have a same identifying numeral. Differences between vehicle configurations 1900 and 1920 are described below. Vehicle 1920 is on a track 1908A, between a track 1908B, to the right, and track 1908C, to the left. Beacons 1924L and 1924R are mounted near or on the track 1908B, and beacons 1926L and 1926R are mounted near or on the track 1908C. Beacons 1922L and 1922R are mounted near or on the track 1908A. All beacons near or on the tracks described in FIG. 19B are ahead, in a direction of travel, of vehicle 1902. Beacons 1902L and 1902R are positioned at the front of vehicle 1902, and are configured to transmit coded pulses to trackside beacons. Inter-beacon distances R1R, R2R, R3R, and R4R are measured between beacons 1902L and 1902R, and beacons 1924L and 1924R, as shown in FIG. 19B. Similarly, inter-beacon distances R1L, R2L, R3L, and R4L are measured between 1902L and 1902R, and beacons 1926L and 1926R. Under some circumstances, localization using beacons directly ahead, along a same track, of a vehicle is impracticable, and beacon pairs at adjacent tracks are used in order to determine inter-beacon distances for localization purposes, in a manner similar to the methods of determining localization described above.

Figures 20A, 20B, 20C, 20D:
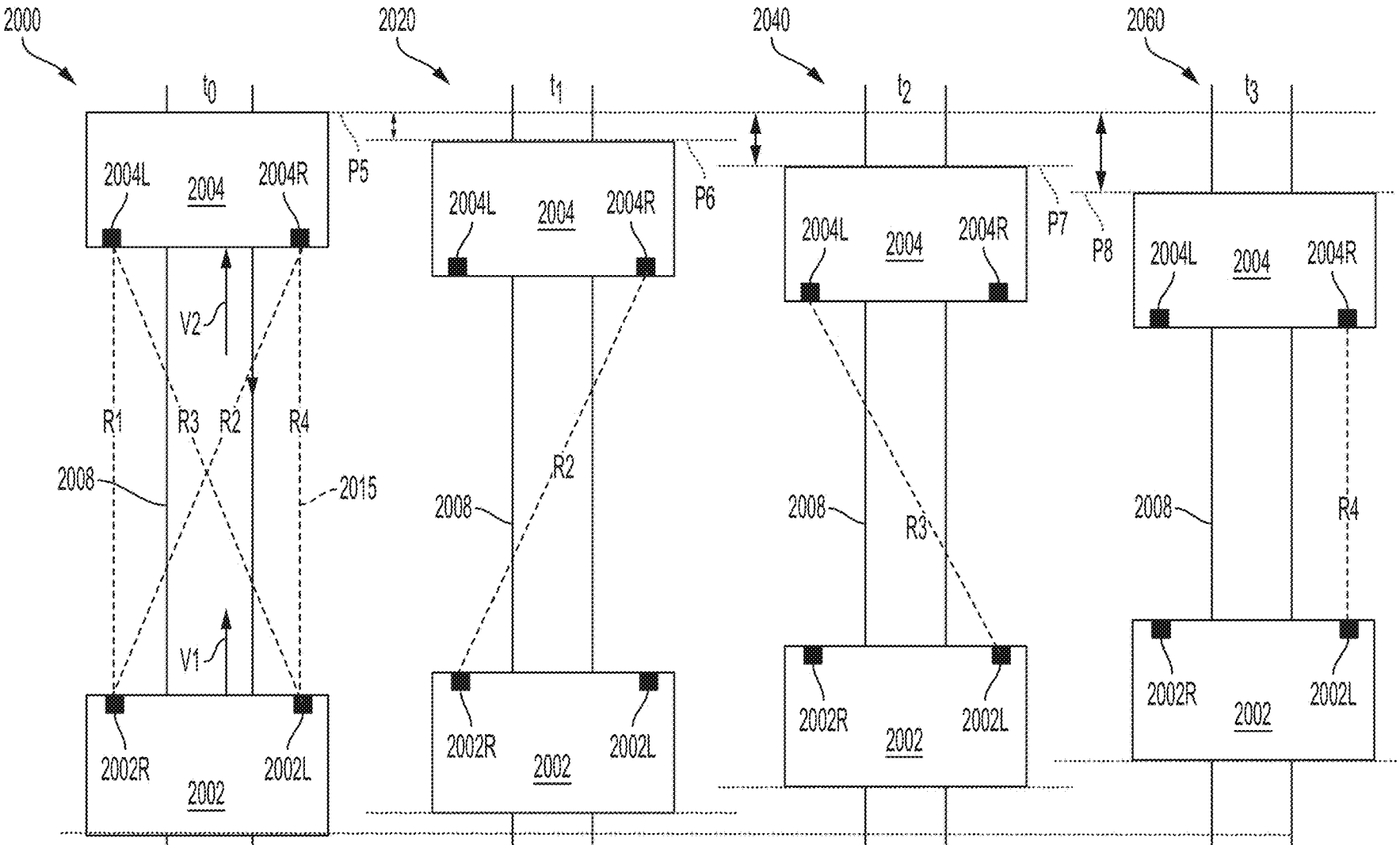
FIGS. 20A-20D are views of a vehicle during obstacle avoidance, in accordance with some embodiments.

FIGS. 20A-20D are views of a vehicle during obstacle avoidance, in accordance with some embodiments. FIG. 20A is a top view of a vehicle configuration 2000, according to some embodiments. In vehicle configuration 2000, vehicle 2002 and vehicle 2004 are on a same track 2008 and closing with each other. Vehicle 2002 has a first velocity V1 toward vehicle 2004, and vehicle 2004 has a second velocity V2 toward vehicle 2002. Vehicle 2002 has a left beacon 2002L and a right beacon 2002R. Vehicle 2004 has a left beacon 2004L and a right beacon 2004R. In FIG. 20A, inter-beacon distances R1, R2, R3, and R4 are shown as being measured at a same time. However, inter-beacon distances R1 to R4 are not always measured at the same time, resulting in position error or position uncertainty, from comparing R1 and R4. To overcome this error or uncertainty, each measurement is provided with an associated measurement age, and a measurement timestamp in the obstacle avoidance computer. The relative velocities between the vehicles 2002 and 2004 (see velocities V1 and V2) are estimated by dividing the range (e.g. R1 or R4) measured in two (2) consecutive measurements by the time elapsed between the two (2) measurements. Thus, FIG. 20A is vehicle configuration 2000 at a first time t0. Vehicle 2002 is at a first position P1, and vehicle 2004 is at a second position P5. Inter-vehicle distance 2015 is the distance between vehicle 2002 and vehicle 2004 at t0.

FIG. 20B is a top view of vehicle configuration 2020, according to some embodiments. In vehicle configuration 2020, elements which are similar to elements of vehicle configuration have a same identifying numeral. Differences are described below. In vehicle configuration 2020, the time is t1 after t0. Vehicle 2002 is a position P2 and vehicle 2004 is at position P6.

FIG. 20C is a top view of vehicle configuration 2040, according to some embodiments. In vehicle configuration 2040, elements which are similar to elements of vehicle configuration 2000 have a same identifying numeral. Differences are described below. In vehicle configuration 2040, the time is t2 after t0. Vehicle 2002 is a position P3 and vehicle 2004 is at position P7.

FIG. 20D is a top view of vehicle configuration 2060, according to some embodiments. In vehicle configuration 2060, elements which are similar to elements of vehicle configuration 2000 have a same identifying numeral. Differences are described below. In vehicle configuration 2060, the time is t3 after t0. Vehicle 2002 is at position P4 and vehicle 2004 is at position P8. The inter vehicle distance is determined by the following equations:

$$V1+V2=(R1t2-R1t1)/(t2-t1) \quad \text{Equation (28)}$$

$$V1+V2=(R4t4-R4t3)/(t4-t3) \quad \text{Equation (29)}$$

The relative speed between the two (2) vehicles is determined to be the average speed based on Equations (28) and (29) above, therefore each measurement taken at a time after t0 can be adjusted as it was taken at t equal to t0 as depicted in Diagram 20.

The inter-beacon distances provided by the right beacon (R1, R2) and the inter-beacon distances provided by the left beacon (R3, R4) are able to be augmented by the other vehicle speed and its end (beacon) leading/trailing state. The inter-beacon distances provided by the right beacon (R1, R2) and the inter-beacon distances provided by the left beacon (R3, R4) are reported as frequently as possible to minimize the influence of measurement age or signal latency. Synchronized measurement of R1 and R4 is preferred. In some embodiments, to avoid cross influence between beacons as a result of signal synchronicity, the beacons are operated on a same face of the vehicle with two non-overlapping frequency bands. Aspects of the present disclosure relate to a method of detecting vehicles and determining if the detected vehicles are obstacles based on positions of beacons on the other vehicles. Aspects of the present disclosure relate to a method of localizing a vehicle based on beacon positions on other vehicles, or on beacons on or near the tracks. Aspects of the present disclosure relate to a method of determining whether vehicles in a train are coupled to each other. Aspects of the present disclosure relate to a method of determining a length of a train.

Figure 21:
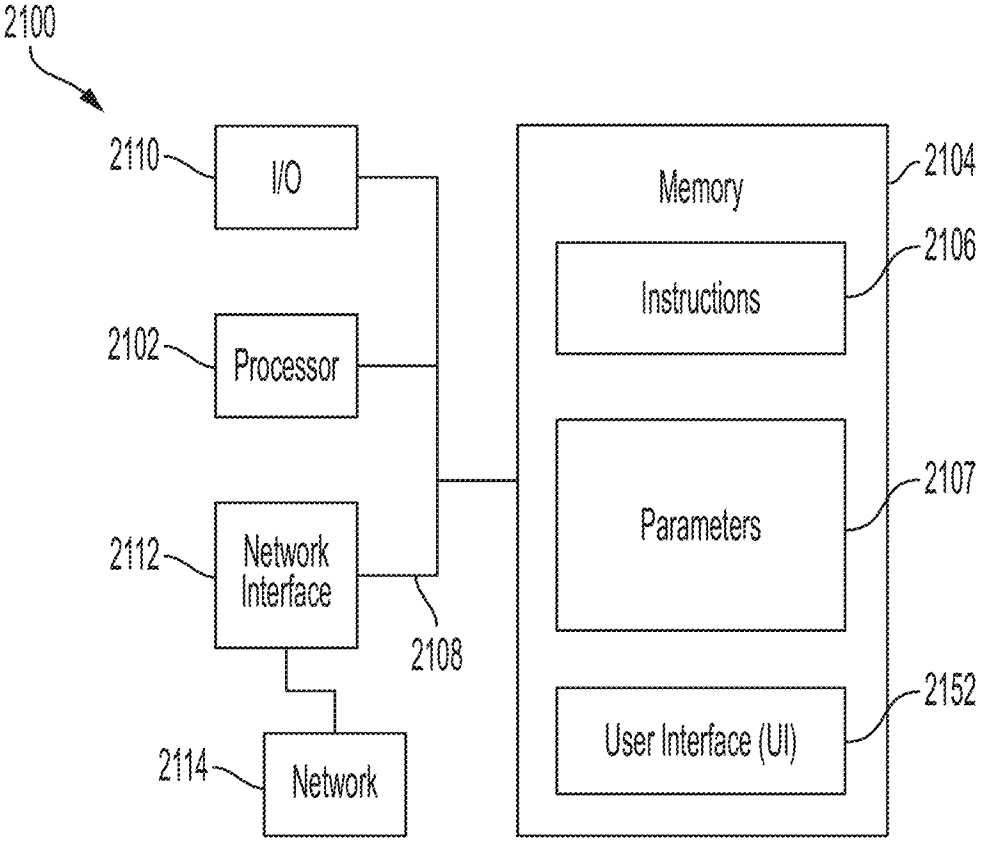
FIG. 21 is a high-level block diagram of a processor-based system usable in conjunction with one or more embodiments.

FIG. 21 is a block diagram of a vehicle obstacle avoidance and localization computer system 2100 in accordance with some embodiments. Some embodiments of a vehicle obstacle avoidance and localization computer are described above at FIGS. 13A and 13B.

In some embodiments, vehicle obstacle avoidance and localization computer system 2100 is a general purpose computing device including a hardware processor 2102 and a non-transitory, computer-readable storage medium 2104. Storage medium 2104 is encoded with, e.g., stores, computer program code 2106, e.g., a set of executable instructions. Execution of instructions 2106 by hardware processor 2102 represents (at least in part) a vehicle obstacle avoidance and localization computer system which implements a portion or all of the methods described herein in accordance with one or more embodiments (hereinafter, the noted processes and/or methods).

Processor 2102 is electrically coupled to computer-readable storage medium 2104 via a bus 2108. Processor 2102 is also electrically coupled to an I/O interface 2110 by bus 2108. A network interface 2112 is also electrically connected to processor 2102 via bus 2108. Network interface 2112 is connected to a network 2114, so that processor 2102 and computer-readable storage medium 2104 are capable of connecting to external elements via network 2114. Processor 2102 is configured to execute computer program code 2106 encoded in computer-readable storage medium 2104 in order to cause system 2100 to be usable for performing a portion or all of the noted processes and/or methods. In one or more embodiments, processor 2102 is a central processing unit (CPU), a multi-processor, a distributed processing system, an application specific integrated circuit (ASIC), and/or a suitable processing unit.

In one or more embodiments, computer-readable storage medium 2104 is an electronic, magnetic, optical, electromagnetic, infrared, and/or a semiconductor system (or apparatus or device). For example, computer-readable storage medium 2104 includes a semiconductor or solid-state memory, a magnetic tape, a removable computer diskette, a random access memory (RAM), a read-only memory (ROM), a rigid magnetic disk, and/or an optical disk. In one or more embodiments using optical disks, computer-readable storage medium 2104 includes a compact disk-read only memory (CD-ROM), a compact disk-read/write (CD-R/W), and/or a digital video disc (DVD).

In one or more embodiments, storage medium 2104 stores computer program code 2106 configured to cause system 2100 to be usable for performing a portion or all of the noted processes and/or methods. In one or more embodiments, storage medium 2104 also stores information which facilitates performing a portion or all of the noted processes and/or methods. In one or more embodiments, storage medium 2104 stores parameters 2107 described in greater detail below.

Vehicle obstacle avoidance and localization computer system 2100 includes I/O interface 2110. I/O interface 2110 is coupled to external circuitry. In one or more embodiments, I/O interface 2110 includes a keyboard, keypad, mouse, trackball, trackpad, touchscreen, and/or cursor direction keys for communicating information and commands to processor 2102.

Vehicle obstacle avoidance and localization computer system 2100 also includes network interface 2112 coupled to processor 2102. Network interface 2112 allows system 2100 to communicate with network 2114, to which one or more other computer systems are connected. Network interface 2112 includes wireless network interfaces such as BLUETOOTH, WIFI, WIMAX, GPRS, or WCDMA; or wired network interfaces such as ETHERNET, USB, or IEEE-1364. In one or more embodiments, a portion or all of noted processes and/or methods, is implemented in two or more systems 2100.

Vehicle obstacle avoidance and localization computer system 2100 is configured to receive information through I/O interface 2110. I/O interface is configured to send and receive instructions 2106 into and out of the vehicle obstacle avoidance and localization computer system 2100. The information received through I/O interface 2110 includes parameters 2107 such sensor data from beacons, range data from range-finding devices, images from cameras, and/or other train position and track condition information gathered for determining inter-vehicle distances. In some embodiments, parameters 2107 received through the I/O interface 2110 also include information coded into a pulse received from another beacon, including both trackside beacons and vehicle-mounted beacons, which provide information about vehicles in a train, such as vehicle orientation, vehicle identification, and pulse transmission times for calculating time-of-flight between beacons, among other information related to obstacle avoidance and localization as described above. In some embodiments, signals and/or data is stored, handled, and/or manipulated by the vehicle obstacle avoidance and localization computer system 2100, in order to perform safety operations for the vehicle on the tracks, and/or other operations for operating a vehicle on a track or guideway. The information is transferred to processor 2102 via bus 2108. Vehicle obstacle avoidance and localization computer system 2100 is configured to receive information related to a UI through I/O interface 2110. The information is stored in computer-readable medium 2104 as user interface (UI) 2142.

In some embodiments, a portion or all of the noted processes and/or methods is implemented as a standalone software application for execution by a processor. In some embodiments, a portion or all of the noted processes and/or methods is implemented as a software application that is a part of an additional software application. In some embodiments, a portion or all of the noted processes and/or methods is implemented as a plug-in to a software application.

In some embodiments, the processes are realized as functions of a program stored in a non-transitory computer readable recording medium. Examples of a non-transitory computer readable recording medium include, but are not limited to, external/removable and/or internal/built-in storage or memory unit, e.g., one or more of an optical disk, such as a DVD, a magnetic disk, such as a hard disk, a semiconductor memory, such as a ROM, a RAM, a memory card, and the like.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

transmitting, from at least two vehicle beacons on a first vehicle, a ranging signal to at least two external beacons, wherein the transmitting the ranging signal to the at least two external beacons comprises:

transmitting, from a first beacon of the at least two vehicle beacons on the first vehicle, a first ranging signal to a first and a second external beacon of the at least two external beacons on a second vehicle; and transmitting, from a second beacon of the at least two vehicle beacons on the first vehicle, a second ranging signal to the first and the second external beacon of the at least two external beacons on the second vehicle;

receiving, at the at least two vehicle beacons, a return signal from the at least two external beacons, wherein the receiving the return signal from the at least two external beacons comprises:

receiving, at the first and the second beacon of the at least two vehicle beacons on the first vehicle, a first return signal from the first external beacon of the at least two external beacons, and receiving, at the first and the second beacon of the at least two vehicle beacons on the first vehicle, a second return signal from the second external beacon of the at least two external beacons;

determining, by a processor based on the return signal from the at least two external beacons, a position of each of the external beacons with respect to the at least two vehicle beacons of the first vehicle;

determining, by the processor, whether the at least two external beacons are associated with the second vehicle on a same track as the first vehicle; and determining, by the processor, a separation distance between the first vehicle and the second vehicle.

2. The method of claim 1, wherein:

the determining the position of each of the external beacons with respect to the at least two vehicle beacons of the first vehicle comprises:

determining, by the processor, whether the at least two external beacons are associated with the second vehicle on a different track from the first vehicle.

3. The method of claim 1, wherein:

the determining the position of each of the external beacons with respect to the at least two vehicle beacons of the first vehicle comprises:

determining, by the processor, whether the at least two external beacons are associated with a track below the first vehicle.

4. The method of claim 1, further comprising:

determining, by the processor, an inter-beacon distance based on the first return signal and the second return signal received by comparing a signal transit time for each of the first return signal and the second return signal at the first and the second beacon of the at least two vehicle beacons on the first vehicle.

5. A method, comprising:

measuring a value of an inter-beacon distance between each beacon of two or more beacons on a first vehicle, and each beacon of a set of two or more beacons on a second vehicle, thereby generating first through fourth measured inter-beacon distance values;

calculating an inter-vehicle distance from the first vehicle to the second vehicle based on the first through fourth measured inter-beacon distance values;

comparing the calculated inter-vehicle distance, and the first through fourth measured inter-beacon distance values to a set of vehicle configuration models;

calculating, based on the set of vehicle configuration models, modeled values corresponding to the first through fourth measured inter-beacon distance values;

determining whether the measured and calculated inter-beacon distance values converge; and performing a safety operation based on the determination.

6. The method of claim 5, further comprising:

adjusting an inter-track distance before calculating the modeled value of each inter-beacon distance.

7. The method of claim 5, wherein the performing the safety operation comprises applying brakes of the first vehicle.

8. The method of claim 5, further comprising determining whether the first vehicle and the second vehicle are on a same track.

9. The method of claim 8, further comprising determining that the first vehicle and the second vehicle are not on the same track, and incrementing an inter-track separation distance in response to the determination that the first vehicle and the second vehicle are not on the same track.

10. The method of claim 5, wherein the performing the safety operation comprises:

transmitting to the second vehicle, information related to a second vehicle position.

11. A system for calculating vehicle position, the system comprising:

a set of first beacons on a first vehicle, each first beacon on the first vehicle configured to transmit a corresponding coded pulse;

a set of second beacons external to the first vehicle, each second beacon configured to receive each coded pulse and to transmit a corresponding reply pulse; and an obstacle avoidance computer of the first vehicle, the obstacle avoidance computer configured to based on the reply pulses received by each first beacon, determine a plurality of inter-beacon distances between corresponding first beacons of the set of first beacons and second beacons of the set of second beacons, and calculate a position of a second vehicle by determining a chord from the plurality of inter-beacon distances.

12. The system of claim 11, wherein the obstacle avoidance computer of the first vehicle is further configured to initiate a safety operation based on the position of the second vehicle.

13. The system of claim 11, further comprising:

a second vehicle obstacle avoidance computer configured to calculate a second vehicle position based on a time-of-flight measurement based on the coded pulse from each first beacon.

14. The system of claim 13, wherein the second vehicle obstacle avoidance computer is further configured to initiate motion of the second vehicle upon determining the second vehicle position.

15. The system of claim 14, wherein:

the second vehicle obstacle avoidance computer is further configured to cause each second beacon of the set of second beacons to transmit coded pulses to a set of third beacons external to the first vehicle and the second vehicle, and receive response pulses from the set of third beacons, and refine the second vehicle position based on a time-of-flight measurement based on the response pulses from the set of third beacons.

16. The system of claim 11, wherein:

each second beacon is configured to include the coded pulse in the reply pulse before transmitting the reply pulse.

17. The system of claim 11, further comprising a range-finding system configured to perform an inter-vehicle distance measurement for the obstacle avoidance computer of the first vehicle.

18. The method of claim 1, wherein the determining, by the processor, the separation distance between the first vehicle and the second vehicle comprises:

measuring an inter-beacon distance for each vehicle beacon of the at least two vehicle beacons on the first vehicle, with respect to each external beacon of the at least two external beacons on the second vehicle; and calculating the separation distance based on the inter-beacon distances from the first vehicle to the second vehicle.

19. The method of claim 18, further comprising:

comparing the separation distance, and the measured inter-beacon distances, to a set of vehicle configuration models.

20. The method of claim 19, further comprising:

calculating, based on the set of vehicle configuration models, a modeled value of each inter-beacon distance.

* * * * *